US007478846B2

(12) United States Patent
Yoshikuwa et al.

(10) Patent No.: US 7,478,846 B2
(45) Date of Patent: Jan. 20, 2009

(54) DOOR LOCK DEVICE AND ASSEMBLING METHOD THEREOF

(75) Inventors: Masakatsu Yoshikuwa, Yamanashi (JP); Takao Taga, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 11/657,059

(22) Filed: Jan. 24, 2007

(65) Prior Publication Data

US 2007/0182165 A1 Aug. 9, 2007

(30) Foreign Application Priority Data

Jan. 25, 2006 (JP) ..... 2006-016644

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS

| | | | | | |
|---|---|---|---|---|---|
| 4,358,141 | A * | 11/1982 | Hamada | 292/216 |
| 4,647,092 | A * | 3/1987 | Nakamura | 292/216 |
| 4,763,936 | A * | 8/1988 | Rogakos et al. | 292/201 |
| 4,775,176 | A * | 10/1988 | Ikeda | 292/216 |
| 4,948,183 | A * | 8/1990 | Yamada | 292/199 |
| 5,169,186 | A * | 12/1992 | Fukumoto et al. | 292/201 |
| 5,564,761 | A * | 10/1996 | Mizuki et al. | 292/201 |
| 5,632,517 | A * | 5/1997 | Paulik et al. | 292/341.12 |
| 5,649,726 | A * | 7/1997 | Rogers et al. | 292/201 |
| 5,709,420 | A * | 1/1998 | Umino | 292/216 |
| 5,785,366 | A * | 7/1998 | Takaishi et al. | 292/341.12 |
| 5,794,992 | A * | 8/1998 | Yoneyama | 292/216 |
| 5,842,728 | A * | 12/1998 | Umino | 292/216 |
| 5,860,683 | A * | 1/1999 | Sekino et al. | 292/216 |
| 6,168,216 | B1 * | 1/2001 | Nakajima et al. | 292/201 |
| 6,722,714 | B2 * | 4/2004 | Ooe et al. | 292/216 |
| 2005/0099016 | A1 * | 5/2005 | Inoue | 292/216 |
| 2005/0140148 | A1 * | 6/2005 | Stoof et al. | 292/216 |
| 2006/0006670 | A1 * | 1/2006 | Song | 292/216 |

FOREIGN PATENT DOCUMENTS

| | | |
|---|---|---|
| JP | 52-23448 | 6/1977 |

(Continued)

OTHER PUBLICATIONS

Korean Office Action issued in Korean Patent Application No. KR 10-2007-0007458, dated on Jan. 25, 2008.

*Primary Examiner*—Patricia L Engle
*Assistant Examiner*—Alyson M Merlino
(74) *Attorney, Agent, or Firm*—McDermott Will & Emery LLP

(57) ABSTRACT

A ratchet shaft is mounted on the base plate beforehand. The ratchet shaft includes, at its base end with a flange collar, a first stepped portion that supports a ratchet lever to be rotatable, and a second stepped portion that receives the thickness of a base plate at the front end of the first stepped portion. The second stepped portion is caulked to the base plate with the ratchet lever resting on the first stepped portion and the base plate resting on the second stepped portion.

2 Claims, 20 Drawing Sheets

FOREIGN PATENT DOCUMENTS

| | | | |
|---|---|---|---|
| JP | 63-78977 | A | 4/1988 |
| JP | 6-3921 | Y2 | 2/1994 |
| JP | 11-2056 | A | 1/1999 |
| JP | 2002-129809 | A | 5/2002 |
| KR | 10-1999-0014737 | A | 2/1999 |
| KR | 10-2001-0012918 | A | 2/2001 |
| KR | 10-0332349 | B | 3/2002 |
| KR | 2002-0031795 | | 5/2002 |
| WO | WO 96/35853 | | 11/1996 |

* cited by examiner

DOOR LOCK DEVICE AND ASSEMBLING METHOD THEREOF

BACKGROUND OF THE INVENTION

1. Field of the Invention

The present invention relates to a door lock device and an assembling method of the door lock device.

2. Description of the Related Art

In a vehicle door lock device, usually a latch and a ratchet are inserted into a housing through an opening of the housing. The latch and the ratchet are caulked, through the shafts of the latch and the ratchet, both to a base and a cover that covers the opening. The shaft of the ratchet has a ratchet lever that engages with the ratchet and rotates when the ratchet rotates. The ratchet lever is arranged outside the base.

Japanese Patent Application Laid-Open No. H11-2056discloses a ratchet shaft wherein a brim member is arranged in the mid portion of the ratchet shaft, and the shaft is caulked at both ends from the cover side and the base side. Thus, the play in a ratchet and a ratchet lever (locking plate) is suppressed in the direction of the shaft axis.

However, in the conventional door lock device, the caulking of both the ends of the ratchet shaft necessitates the assembling operation and the caulking operation to be carried out with the door lock device being reversed, which is disadvantageous in assembling operation.

SUMMARY OF THE INVENTION

It is an object of the present invention to at least partially solve the problems in the conventional technology.

According to an aspect of the present invention, a door lock device includes a housing that accommodates a latch and a ratchet, and a first surface with an opening and a second surface, which is sandwiched between a cover plate that covers the opening and a base plate on the second surface, a latch shaft that supports the latch, a ratchet shaft that supports the ratchet, a ratchet lever that is supported by the ratchet shaft outside the base plate, while passing through the latch shaft and the ratchet shaft, and moves integrally with the ratchet. The ratchet shaft includes, at its base end with a flange collar, a first stepped portion that supports the ratchet lever to be rotatable, and a second stepped portion that receives a thickness of the base plate at an end of the first stepped portion. The second stepped portion is caulked to the base plate with the ratchet lever resting on the first stepped portion and the base plate resting on the second stepped portion.

According to another aspect of the present invention, an assembling method of a door lock device that accommodates a latch supported by a latch shaft and a ratchet supported by a ratchet shaft in a housing including a first surface with an opening and a second surface, and is sandwiched between a cover plate that covers the opening and a base plate on the second surface, in which a ratchet lever is supported by the ratchet shaft outside the base plate, while passing through the latch shaft and the ratchet shaft, and moves integrally with the ratchet, includes engaging the base plate with the ratchet shaft that supports the ratchet lever to be rotatable, caulking the ratchet shaft to the base plate, engaging the base plate with the latch shaft facing in the same direction as the ratchet shaft, arranging the housing along with the base plate to accommodate the latch shaft and the ratchet shaft, engaging the latch and the ratchet with the latch shaft and the ratchet shaft, respectively, covering the opening with the cover plate, and caulking ends of the latch shaft and ratchet shaft to the cover plate from outside.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings. A door lock device according to an embodiment of the present invention is used to, for example, maintain a door of a vehicle closed and lock the door closed.

Figure 1:
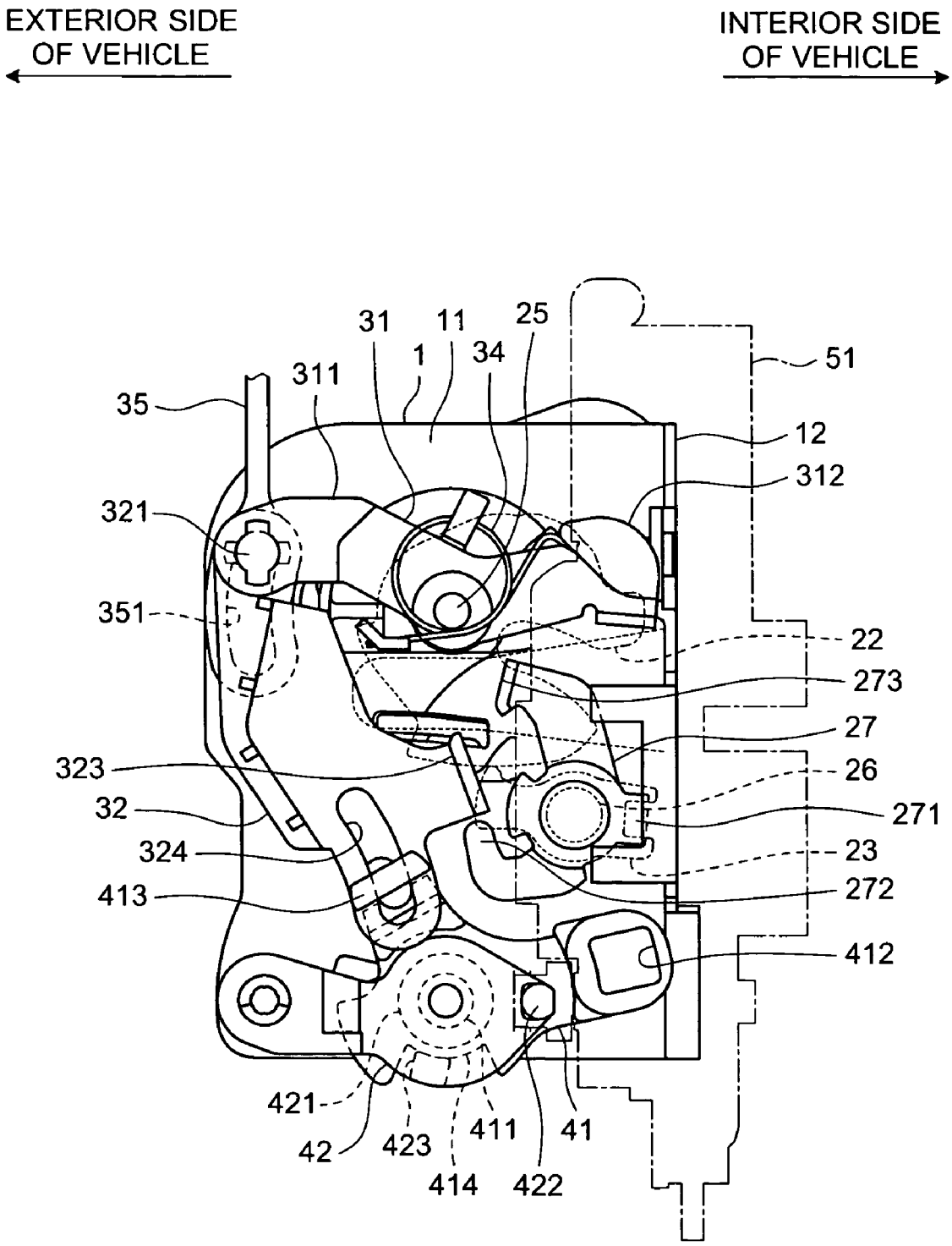
FIG. 1 is a front view of a door lock device according to an embodiment of the present invention.
Figure 2:
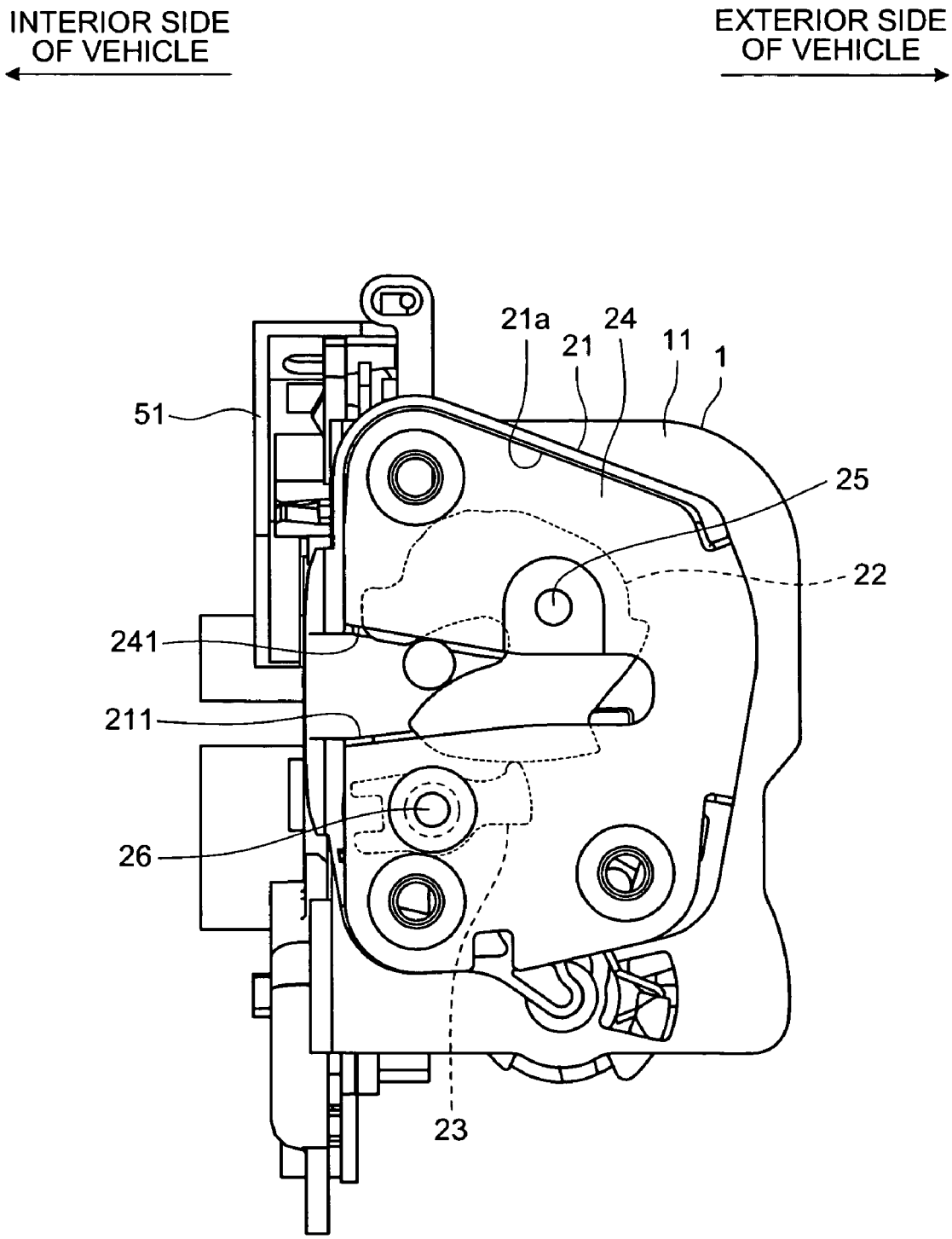
FIG. 2 is a rear view of the door lock device.
Figure 3:
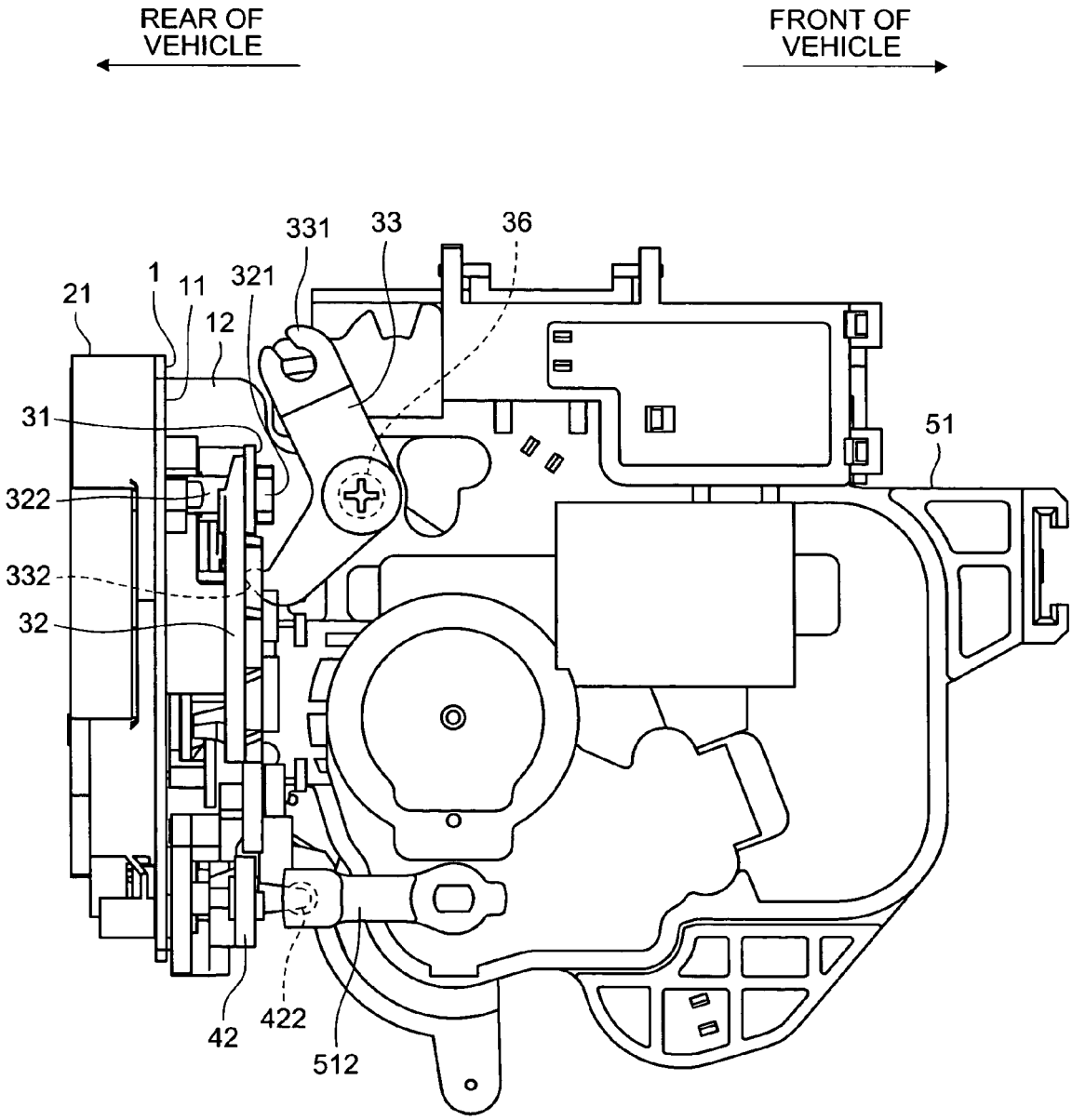
FIG. 3 is a left side view of the door lock device.
Figure 4:
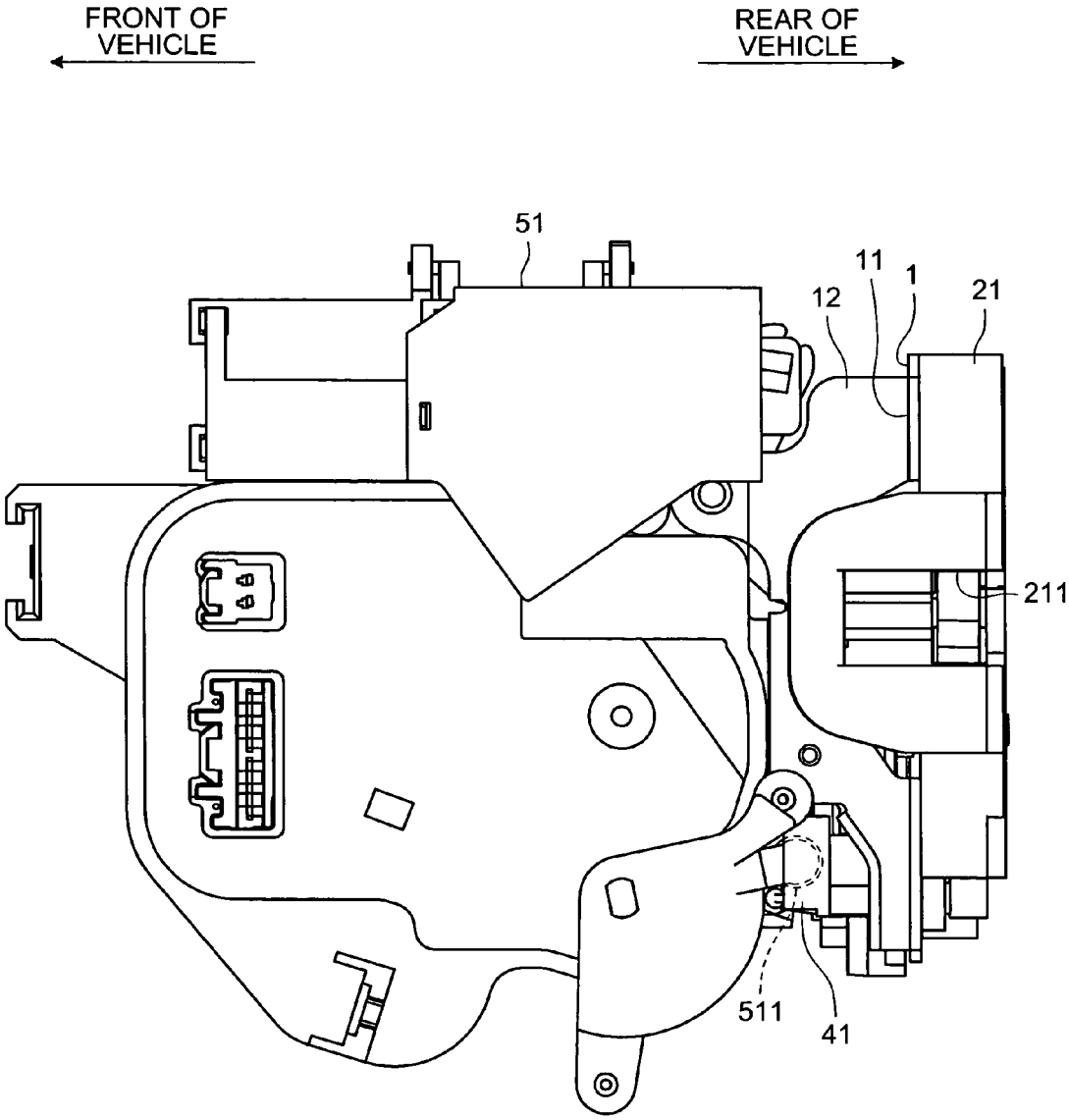
FIG. 4 is a right side view of the door lock device.

FIG. 1 is a front view of the door lock device according to the embodiment. FIG. 2 is a rear view of the door lock device. FIG. 3 is a left side view of the door lock device. FIG. 4 is a right side view of the door lock device.

It is assumed that the door lock device is arranged on a front-hinge door at the right front of a four-wheeled vehicle. As shown in FIGS. 1 to 4, the door lock device includes a latch mechanism and a lock mechanism on a base plate 1. The base plate 1 is formed by clinching or punching a sheet metal. The base plate 1 includes a base 11 that faces front (front of the vehicle body) and a side plate 12 obtained by bending the side of the base 11 substantially at right angles to extend forward, thereby forming a substantially L-shape in the principal section.

As shown in FIGS. 2 to 4, the latch mechanism includes a latch body (housing) 21 formed of synthetic resin. As shown in FIG. 2, the latch body 21 has an opening 21*a* on the rear surface (first surface) and accommodates a latch 22 and a ratchet 23 introduced through the opening 21*a*. The opening 21*a* is covered by a cover plate 24. The latch body 21 has a horizontal notched groove 211 extending substantially horizontally to the interior side at about the center thereof. The front surface (second surface) of the latch body 21 is fixed to the base 11 of the base plate 1. The cover plate 24 also has a horizontal notched groove 241 similar to the horizontal notched groove 211 of the latch body 21.

The latch 22 and the ratchet 23 retain, by meshing engagement, a striker S (see FIGS. 5 to 7) on the body of the four-wheeled vehicle as in the conventional manner.

Figure 5:
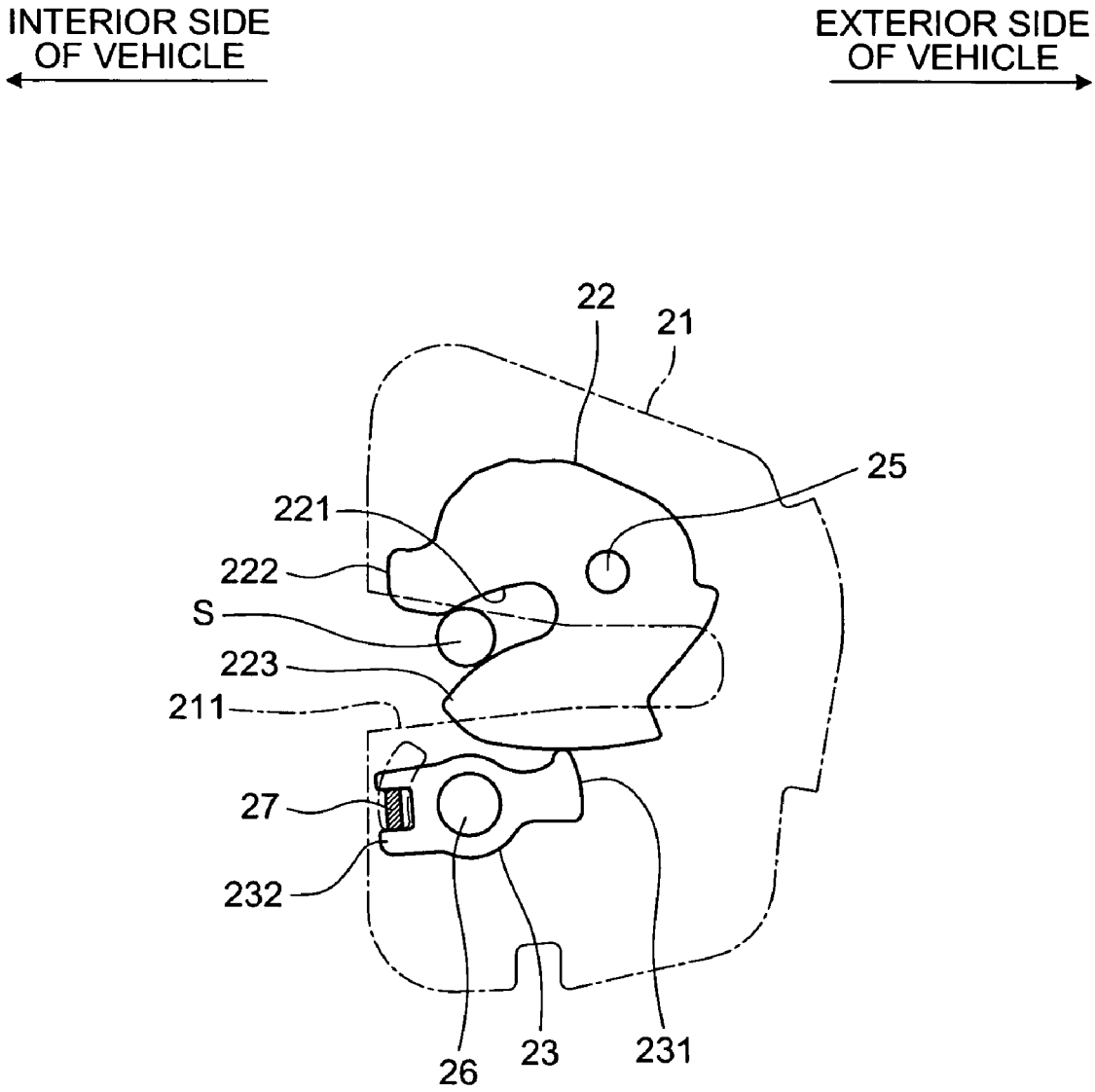
FIG. 5 is a schematic for explaining the operation of a latch mechanism.
Figure 6:
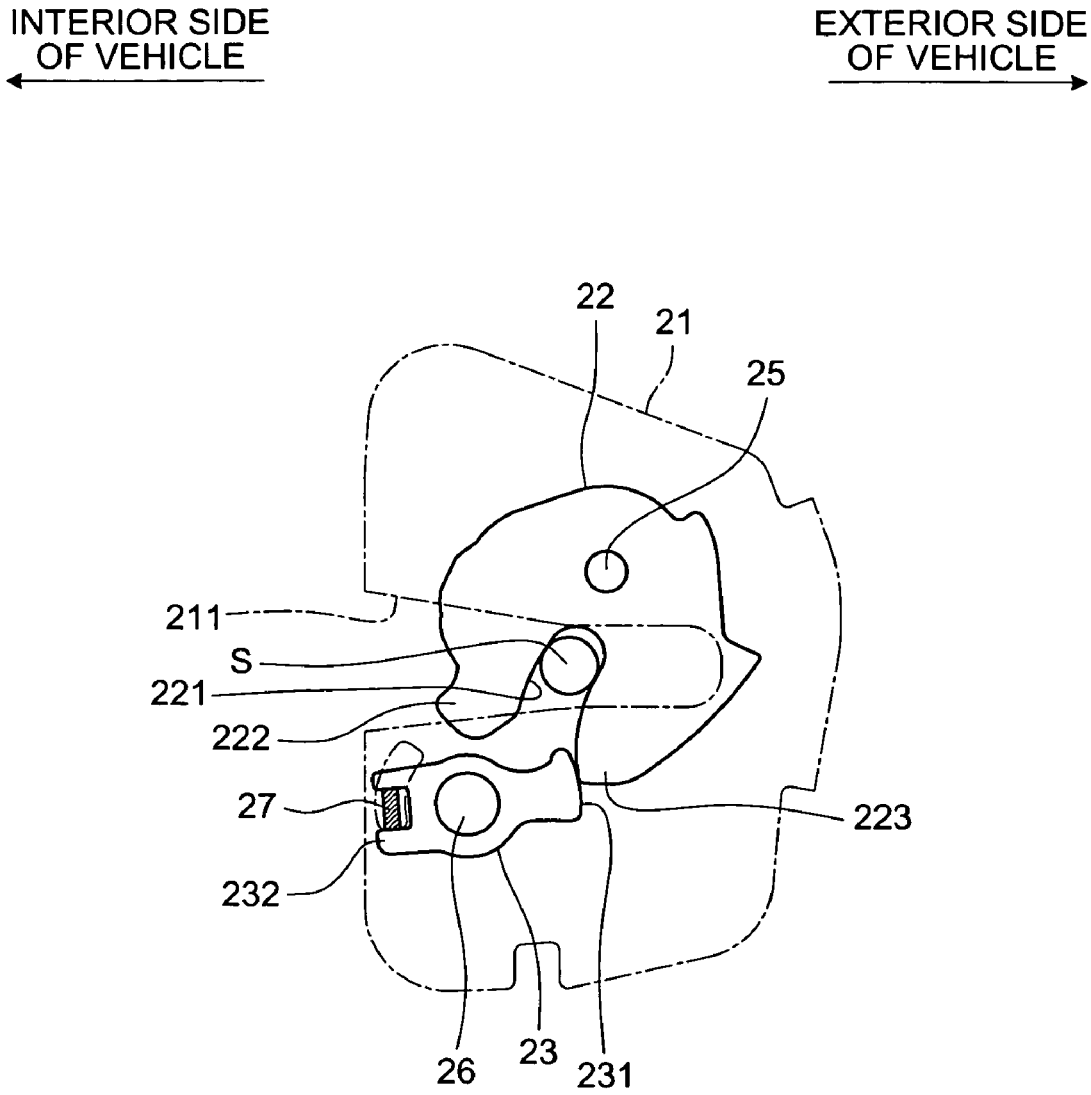
FIG. 6 is another schematic for explaining the operation of the latch mechanism.
Figure 7:
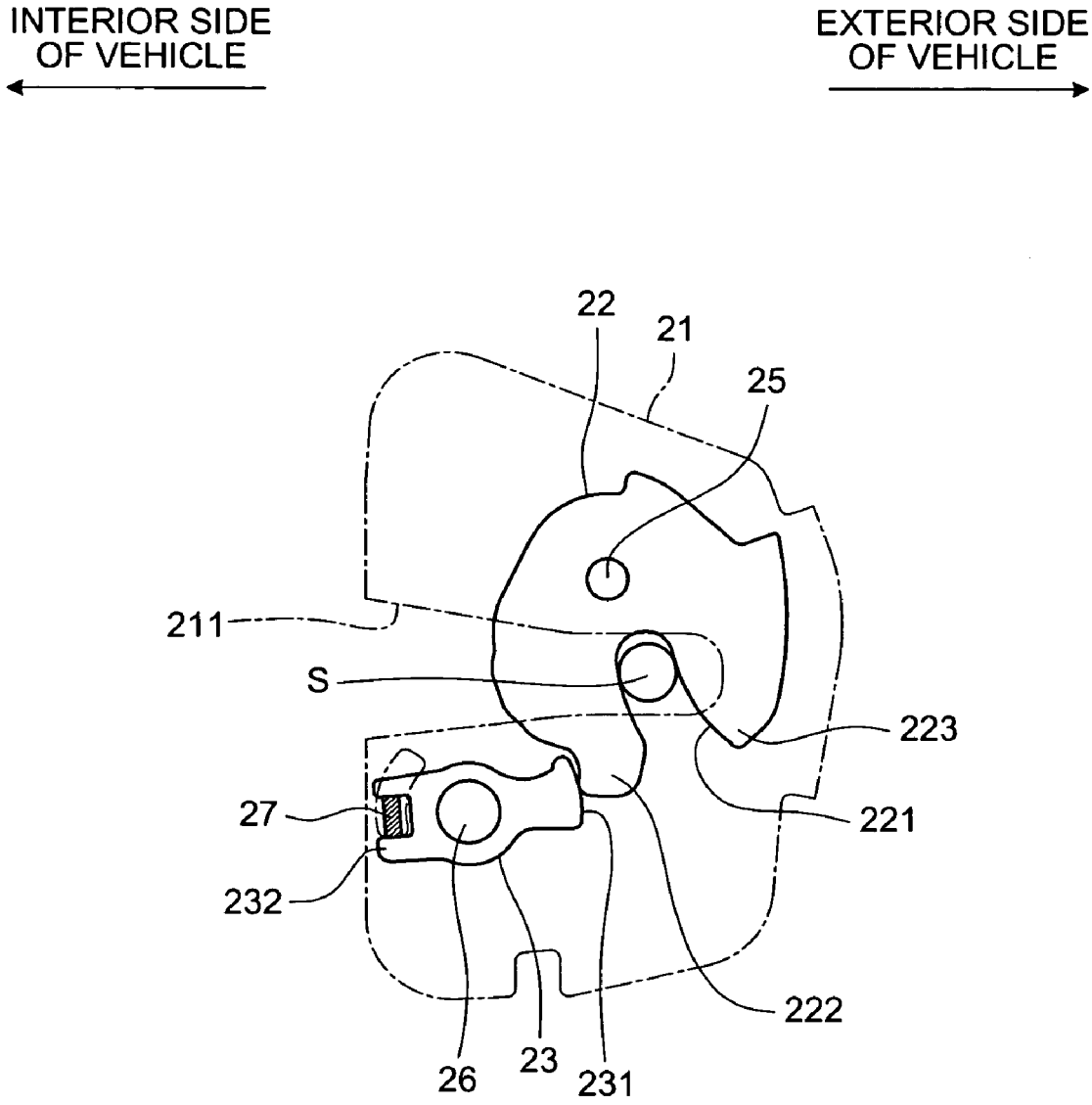
FIG. 7 is yet another schematic for explaining the operation of the latch mechanism.

As shown in FIGS. 5 to 7, the latch 22 is arranged rotatably about a latch shaft 25 extending substantially horizontally along the longitudinal (front-back) direction of the vehicle body at a position higher than the horizontal notched groove 211, and includes a meshing groove 221, a hook 222, and a latch member 223.

The meshing groove 221 extends from the outer peripheral surface of the latch 22 to the latch shaft 25, and is wide enough to accommodate the striker S.

The hook 222 is located more interior than the meshing groove 221 when the meshing groove 221 is opened downward while the latch 22 rotates about the latch shaft 25. The hook 222 stops at a position (full-latched position) where it traverses the horizontal notched groove 211 when the latch 22 is rotated counterclockwise as shown in FIG. 7, whereas it stops at a position (open position) where the horizontal notched groove 211 is opened when the latch 22 is rotated clockwise as shown in FIG. 5.

The latch member 223 is located more exterior than the meshing groove 221 when the meshing groove 221 is opened downward while the latch 22 rotates about the latch shaft 25. The latch member 223 stops at a position where it traverses the horizontal notched groove 211 and gradually slopes upward toward the interior of the horizontal notched groove 211 (exterior side of the vehicle) when the latch 22 is rotated clockwise as shown in FIG. 5. Although not clearly depicted in the drawings, between the latch 22 and the latch body 21 is arranged a latch spring (not shown) that always biases the latch 22 clockwise.

The ratchet 23 is arranged at a position lower than the horizontal notched groove 211 and more interior than the latch shaft 25 to be rotatable about a ratchet shaft 26 extending substantially horizontally along the longitudinal direction of the vehicle body, and includes an engaging member 231 and an acting member 232.

The engaging member 231 extends in an outward radial direction from the ratchet shaft 26 toward the exterior, and is capable of engaging with the hook 222 and the latch member 223 of the latch 22 at its end surface when the ratchet 23 rotates counterclockwise in FIG. 5 to FIG. 7.

The acting member 232 extends in an outward radial direction from the ratchet shaft 26 toward the interior, and is coupled with a ratchet lever 27. The ratchet lever 27 is arranged on the front side of the base 11 (front side of the vehicle) and rotates about the axis of the ratchet shaft 26. In other words, the ratchet 23 rotates about the ratchet shaft 26 together with the ratchet lever 27. Between the ratchet 23 and the latch body 21 is arranged a ratchet spring (not shown) that always biases the ratchet 23 (and the ratchet lever 27) counterclockwise in FIGS. 5 to 7.

In the latch mechanism as described above, when the door of the vehicle is open, the latch 22 assumes an open position as shown in FIG. 5. When the door is closed, the striker S on the vehicle-body side comes in contact with the latch member 223. As a result, the latch 22 rotates counterclockwise against the elastic force of the latch spring. During this action, the end surface of the engaging member 231 comes into sliding contact with the outer peripheral surface of the latch 22 due to the elastic force of the ratchet spring, so that the ratchet 23 rotates about the axis of the ratchet shaft 26 depending on the outer peripheral shape of the latch 22.

When the door is closed from the above state, the amount of entry of the striker S into the horizontal notched groove 211 gradually increases, and hence the latch 22 is pushed by the striker S and further rotates counterclockwise. Eventually, the meshing groove 221 of the latch 22 reaches the engaging member 231 of the ratchet 23 as shown in FIG. 6. In this state, the latch member 223 abuts on the end surface of the engaging member 231, and clockwise rotation of the latch 22 is prevented against elastic resilience of the latch spring. Additionally, the hook 222 of the latch 22 traverses the horizontal notched groove 211, and therefore, the striker S is prevented from moving in a direction departing from the horizontal notched groove 211 by the hook 222, i.e., the door of the vehicle is prevented from opening (half-latched state).

When the door is closed from the half-latched state, the latch 22 further rotates counterclockwise via the latch member 223 due to the striker S entering the horizontal notched groove 211, and eventually, the striker S reaches the horizontal notched groove 211. During this action, the ratchet 23 rotates clockwise against the elastic force of the ratchet spring as the hook 222 comes into contact with the surface of the engaging member 231, and then immediately starts rotating counterclockwise due to elastic resilience of the ratchet spring upon passage of the hook 222. As a result, as shown in FIG. 7, the hook 222 comes into contact with the engaging member 231, so that the latch 22 is prevented from rotating clockwise against elastic resilience of the latch spring. Also in this state, the hook 222 traverses the horizontal notched groove 211, and therefore, the striker S is prevented from moving in a direction departing from the interior of the horizontal notched groove 211 (exterior side of the vehicle) by the hook 222, resulting in the door of the vehicle being kept closed (full-latched state).

Further, when the acting member 232 or the ratchet lever 27 of the ratchet 23 is rotated clockwise about the axis of the ratchet shaft 26 against the elastic force of the ratchet spring from the full-latched state, the abutting engagement between the hook 222 and the engaging member 231 is released, so that the latch 22 rotates clockwise by elastic resilience of the latch spring. As a result, as shown in FIG. 5, the horizontal notched groove 211 is opened, the striker S can be prevented from moving in a direction departing from the horizontal notched groove 211, and the door of the vehicle can be opened.

The ratchet lever 27 is arranged on the front face of the base 11, as shown in FIG. 1, to be rotatable about the axis of the ratchet shaft 26. The ratchet lever 27 includes a linking end 271 that is coupled with the acting member 232 of the ratchet 23, an action end 272, and a pressure receiving end 273 relating to a releasing member, which extend in the radial direction of the ratchet shaft 26.

As shown in FIGS. 1 and 3, the releasing member is arranged on the front side of the base 11 (front side of the vehicle).

The releasing member releases the full-latched or half-latched state of the latch mechanism by rotating the ratchet lever 27 clockwise in FIGS. 5 to 7 to allow the door of the vehicle to be opened. As shown in FIGS. 1 to 3, the releasing member includes an open lever 31, a link lever 32, and an inside handle lever 33.

The open lever 31 is arranged on the upper front side of and the base 11 to be rotatable about the latch shaft 25 against the base 11. An open lever spring 34 is wound around the latch shaft 25. One end of the open lever spring 34 is engaged with the base plate 1 side and the other end is engaged with the open lever 31 side. The open lever spring 34 always urges the open lever 31 clockwise in FIG. 1.

The open lever 31 is formed of sheet metal and includes a first opening operation end 311 and a second opening operation end 312. The first opening operation end 311 extends towards the left in FIG. 1, and is related to the opening operation of an outside door handle (not shown) on the exterior side of the vehicle. The second opening operation end 312 is on the right side in FIG. 1 and extends towards the side plate 12 of the base plate 1 and, and is related to the opening operation of an inside door handle (not shown) on the interior side of the vehicle. The rotation of the open lever 31, urged by the open lever spring 34, is regulated in a state where the second opening operation end 312 is in contact with a fixed structure (a part of the latch body 21 in the embodiment) on the side of the base plate 1.

The link lever 32 is formed of synthetic resin, extends longitudinally in the height direction and is arranged on the left side of the base 11 in FIG. 1. The upper end of the link lever 32 is coupled with the first opening operation end 311 of the open lever 31. Specifically, a first link shaft 321 is arranged on the front surface (first surface) of the upper end of the link lever 32. The link lever 32 is coupled with and is axially supported against the first opening operation end 311 through the first link shaft 321. Further, as shown in FIG. 3, a second link shaft 322 is arranged on the rear surface (second surface) of the upper end of the link lever 32. The link lever 32 is slidably engaged with an oblong slot 351 of an open rod 35 coupled with the outside door handle through the second link shaft 322. On the right side of the link lever 32, an operating member 323 extends sideways. The operating member 323 relates to the action end 272 and the pressure receiving end 273 of the ratchet lever 27. An oblong curved slot 324 is provided at the lower end of the link lever 32. The oblong curved slot 324 engages with the lock mechanism end described later.

The inside handle lever 33 is formed of sheet metal and, as shown in FIG. 3, is arranged rotatably about the axis of a lever shaft 36 on the side plate 12, and includes a linking end 331 and an abutment end 332. The linking end 331 extends upward in FIG. 3 and is coupled with the inside door handle via a cable (not shown). The abutment end 332 extends towards the second opening operation end 312 of the open lever 31, and contacts the second opening operation end 312 when the inside handle lever 33 rotates clockwise in FIG. 3, causing the open lever 31 to rotate counterclockwise in FIG. 1.

Figure 8:
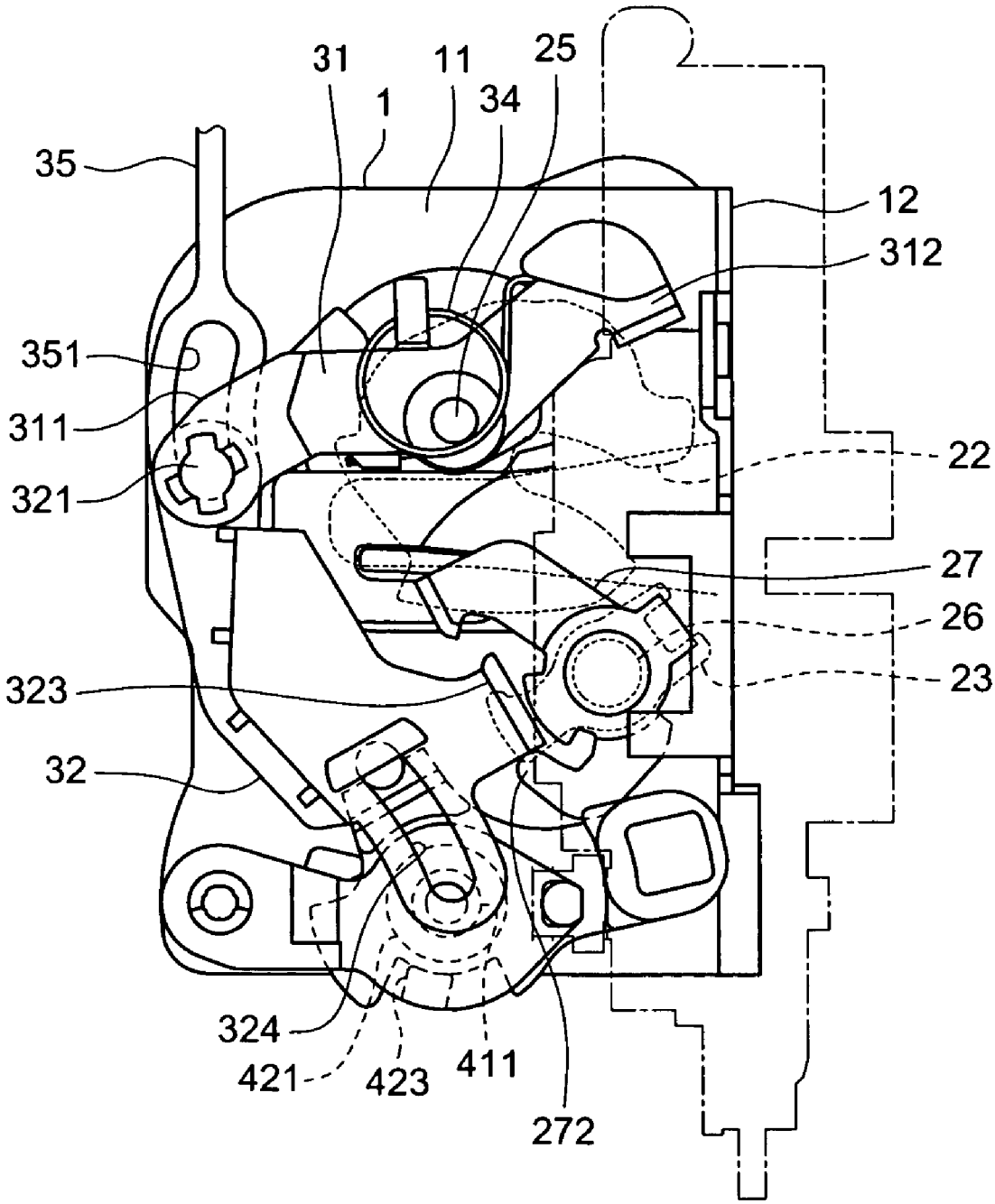
FIG. 8 is a front view of the door lock device for explaining operation to release the latch the latch mechanism.

Thus, in the releasing member, when the outside handle is operated to open the door and the open rod 35 is pushed downward in FIG. 1 or when the inside hand is operated to open the door causing the inside handle lever 33 to rotate clockwise in FIG. 3 in the half-latched state of the latch mechanism shown in FIG. 6 or in the full-latched state of the latch mechanism shown in FIG. 7, the open lever 31 rotates counterclockwise against the elastic force of the open lever spring 34 as shown in FIG. 8. The counterclockwise rotation of the open lever 31 causes the link lever 32 to move downward following the trajectory of the first opening operation end 311. The upper end of the link lever 32 is axially supported by the first link shaft 321 against the first opening operation end 311, and the link lever 32 moves downward in parallel guided by the oblong curved slot 324. With the downward movement of the link lever 32, the operating member 323 of the link lever 32 contacts the action end 272 of the ratchet lever 27, causing the ratchet lever 27 to rotate counterclockwise about the ratchet shaft 26. Thus, the ratchet lever 27 rotates integrally with the ratchet 23, and releases the engagement of the hook 222 with the engaging member 231 as shown in FIG. 5, thereby enabling the door of the vehicle to be opened.

When the open rod 35 is pushed downward in FIG. 1 by operation of the outside handle to open the door, the open lever 31 rotates counterclockwise as shown in FIG. 8 (the open rod 35 is inoperative in FIG. 8), and the second opening operation end 312 moves away from the abutment end 332 of the inside handle lever 33. Therefore, operation of the outside handle has no effect on the inside handle. When the inside handle lever 33 rotates clockwise in FIG. 3 by an operation of the inside handle to open the door, the open lever 31 rotates counterclockwise as shown in FIG. 8; however, the oblong slot 351 prevents the rotation of the open lever 31 from being conveyed to the open rod 35. Therefore, the operation of the inside handle has no effect on the outside handle.

The lock mechanism prevents the action of the releasing member from reaching the ratchet lever 27, thus locking (maintaining) the full-latched state of the latch mechanism. As shown in FIG. 1, the lock mechanism includes a lock lever 41 and a key lever 42.

The lock lever 41 is formed of synthetic resin and is arranged on the lower side of the base 11. The lock lever 41 includes a lock lever shaft 411, which is supported to be rotatable with respect to the base 11. The lock lever 41 is substantially L-shaped with a first leg extending to the right and a second leg extending to the upward in FIG. 1. An engagement slot 412 is formed in the first leg of the lock lever 41. A lock operation lever 511 is in insertion engagement with the engagement slot 412. As shown in FIG. 4, the lock operation lever 511 is located in an actuator 51 fixed to the side plate 12, and is coupled with a locking member (not shown) inside the door (on the interior side of the vehicle). As shown in FIG. 1, an engagement piece 413 is arranged in the second leg of the lock lever 41. The engagement piece 413 is in insertion engagement with the oblong curved slot 324 in the link lever 32 of the releasing member. When the lock lever 41 rotates clockwise or counterclockwise in FIG. 1 about the axis of the lock lever shaft 411, a spring biases the lock lever 41 to maintain the rotation. In the embodiment, the ratchet spring is used as the spring that always biases the rotation of the ratchet 23 (and the ratchet lever 27).

The key lever 42 is formed of synthetic resin and, as shown in FIG. 1, is located on the lower side of the base 11, being stacked on the lock lever 41. The key lever 42 includes a key lever shaft 421, which is supported to be rotatable with respect to the lock lever 41. The key lever shaft 421 is concentric with the lock lever shaft 411. A key rod (not shown) is coupled with a key cylinder (not shown) arranged outside the door (exterior side of the vehicle) is coupled with a first end of the key lever 42 extending to the left in FIG. 1. A key operation detection lever 512 in the actuator 51 as shown in FIG. 3 is coupled with an engagement piece 422 at a second end of the key lever 42 extending to the right in FIG. 1. The key cylinder is configured so that a keyhole into which a key is inserted is always oriented in a predetermined direction (neutral position). With this, the key lever 42 is controlled to locate at a predetermined rotating position shown in FIG. 1.

As shown in FIG. 1, the lock lever 41 has a notched groove 414 along the periphery of the lock lever shaft 411. The key lever 42 has a protrusion piece 423 that engages with the notched groove 414. The engagement of the protrusion piece 423 with the notched groove 414 has a predetermined allowance in the rotation direction of the lock lever 41 and the key lever 42 in.

Figure 9:
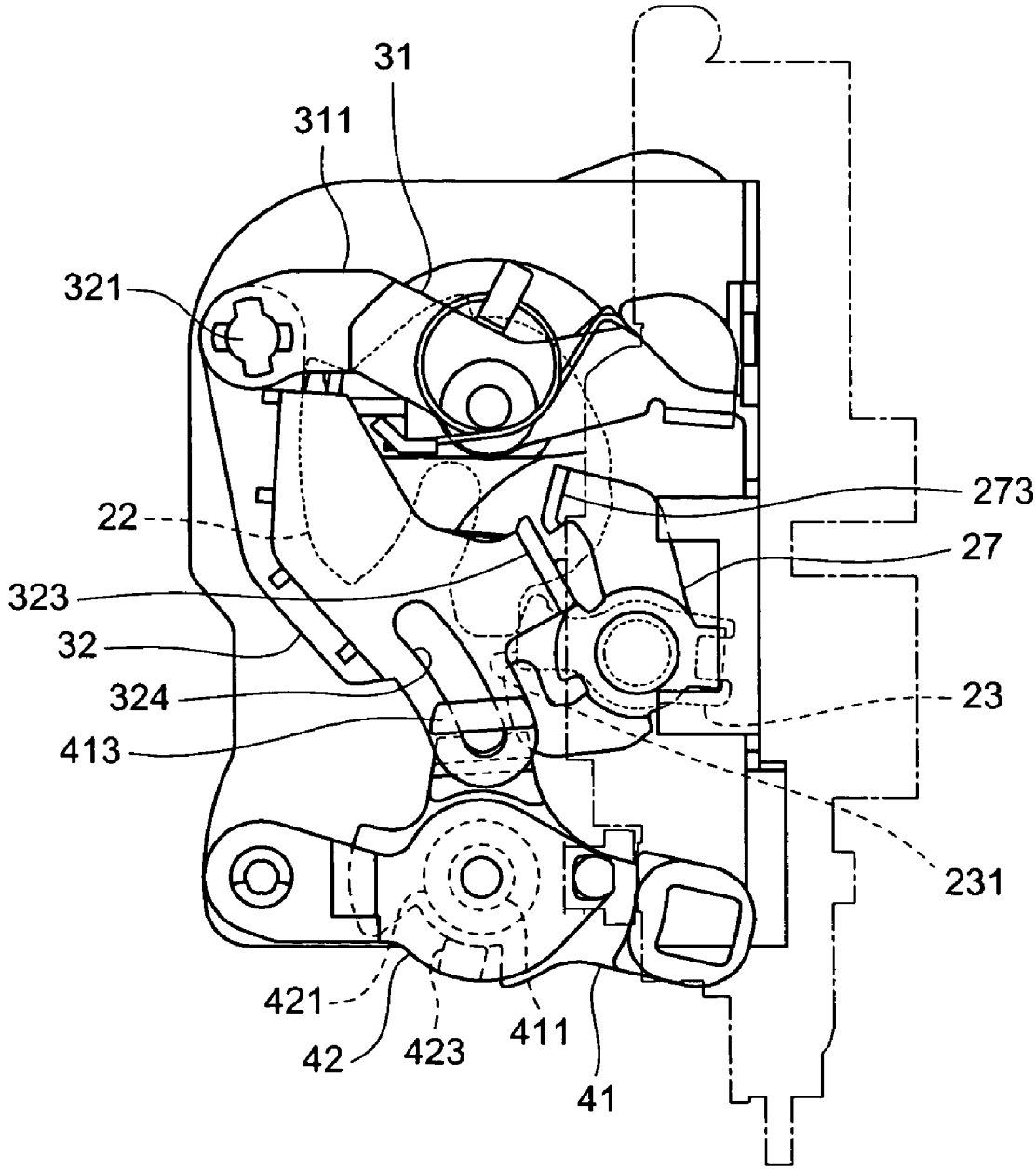
FIG. 9 is a front view of the door lock device for explaining a locked state of a lock mechanism.
Figure 10:
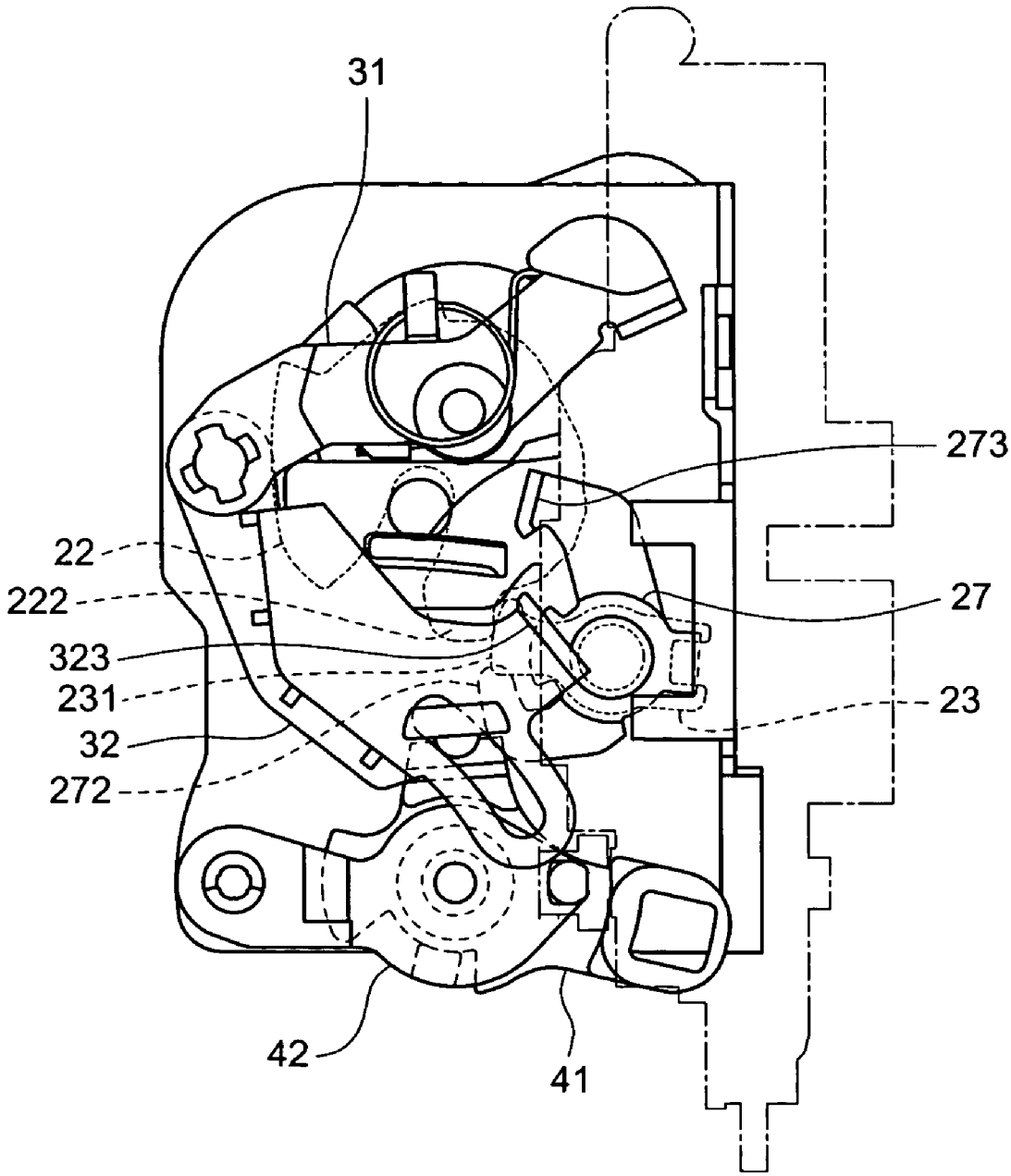
FIG. 10 is a front view of the door lock device for explaining the locked state of the lock mechanism.

In the lock mechanism, when the door of the vehicle is closed and the latch mechanism is in the full-latched state as shown in FIG. 7, if the lock lever 41 rotates clockwise about the axis of the lock lever shaft 411 as shown in FIG. 9 by the operation of the locking member from the inside (on the interior side of the vehicle) or by the actuator 51, the link lever 32 rotates following the trajectory of the engagement piece 413. That is, the upper end of the link lever 32 is axially supported by the first link shaft 321 against the first opening operation end 311 and, as shown in FIG. 9, the link lever 32 rotates counterclockwise about the axis of the first link shaft 321 with the engagement piece 413 of the lock lever 41 being engaged with the oblong curved slot 324 in the lower end of the link lever 32. When the link lever 32 rotates counterclockwise, the operating member 323 moves towards the right. If the releasing member is operated as described above in this state, the link lever 32 moves in parallel as shown in FIG. 10. However, the operating member 323 is not to contact the action end 272. Nor is the abutting engagement between the hook 222 and the engaging member 231 released. As a result, the door of the vehicle is maintained closed, which enables the vehicle to be locked (locked state). The locked state can be achieved when the key lever 42 rotates clockwise in FIG. 1 about the axis of the key lever shaft 421 by key operation from outside the door (exterior side of the vehicle) because the lock lever 41 rotates clockwise about the axis of the lock lever shaft 411.

If, from the locked state, the lock lever 41 rotates counterclockwise about the axis of the lock lever shaft 411 by operation of the locking member from inside the door (on the interior side of the vehicle) or by the actuator 51, the link lever 32 rotates following the trajectory of the engagement piece 413. That is, the upper end of the link lever 32 is axially supported by the first link shaft 321 against the first opening operation end 311 and, as shown in FIG. 1, the link lever 32 rotates clockwise about the axis of the first link shaft 321 with the engagement piece 413 being engaged with the oblong curved slot 324 in the lower end of the link lever 32. When the link lever 32 rotates clockwise, the operating member 323 moves towards the left. If the releasing member is operated as described above in this state, the operating member 323 that has moved in parallel contacts the action end 272 as shown in FIG. 8, thereby releasing the abutting engagement of the hook 222 with the engaging member 231 and enabling the door of the vehicle to be opened (unlocked state). The unlocked state can be achieved when the key lever 42 rotates counterclockwise in FIG. 1 about the axis of the key lever shaft 421 by key operation from outside the door (exterior side of the vehicle) because the lock lever 41 rotates counterclockwise about the axis of the lock lever shaft 411.

In the door lock device according to the embodiment, when the door of the vehicle is open and the latch 22 is in a released position as shown in FIG. 5, the lock mechanism is switched to a locked state by operation of the locking member (see FIG. 9). With this, the operating member 323 moves to the right and faces the pressure receiving end 273 of the ratchet lever 27. When the door is closed from this state, the latch 22 contacting the slider S rotates clockwise towards the full-latched state as shown in FIG. 9. The end of the engaging member 231 comes into sliding contact with the outer peripheral surface of the latch 22, and the ratchet 23 rotates counterclockwise in FIG. 9, and the ratchet lever 27 also rotates counterclockwise. Then, the pressure receiving end 273 pushes the operating member 323 to the left. As a result, both the link lever 32 and the lock lever 41 rotate counterclockwise, switching the lock mechanism back to an unlocked state. In other words, locking the vehicle with the key left inside can be prevented (self-release mechanism) even if by operation of the locking member the lock mechanism is switched to a locked state. On the other hand, if the lock mechanism is switched to a locked state when the door of the vehicle is open (see FIG. 9), and the releasing member is activated by an opening operation of the outside handle or the inside handle, the link lever 32 moves in parallel as shown in FIG. 10, and the operating member 323 moves away from the pressure receiving end 273. If the door is closed in this state, the door of the vehicle can be closed with lock mechanism in a locked state (keyless mechanism) because the pressure receiving end 273 does not come into contact with the operating member 323.

When the lock lever 41 rotates clockwise or counterclockwise about the axis of the lock lever shaft 411, the key lever 42 does not rotate with because of an allowance in the engagement between the notched groove 414 of the lock lever 41 and the protrusion piece 423 of the key lever 42. As a result, when the lock lever 41 rotates about the axis of the lock lever shaft 411 by operation of the locking member from inside the door (on the interior side of the vehicle) or by the actuator 51, the orientation of the keyhole of the key cylinder remains unchanged.

Figure 11:
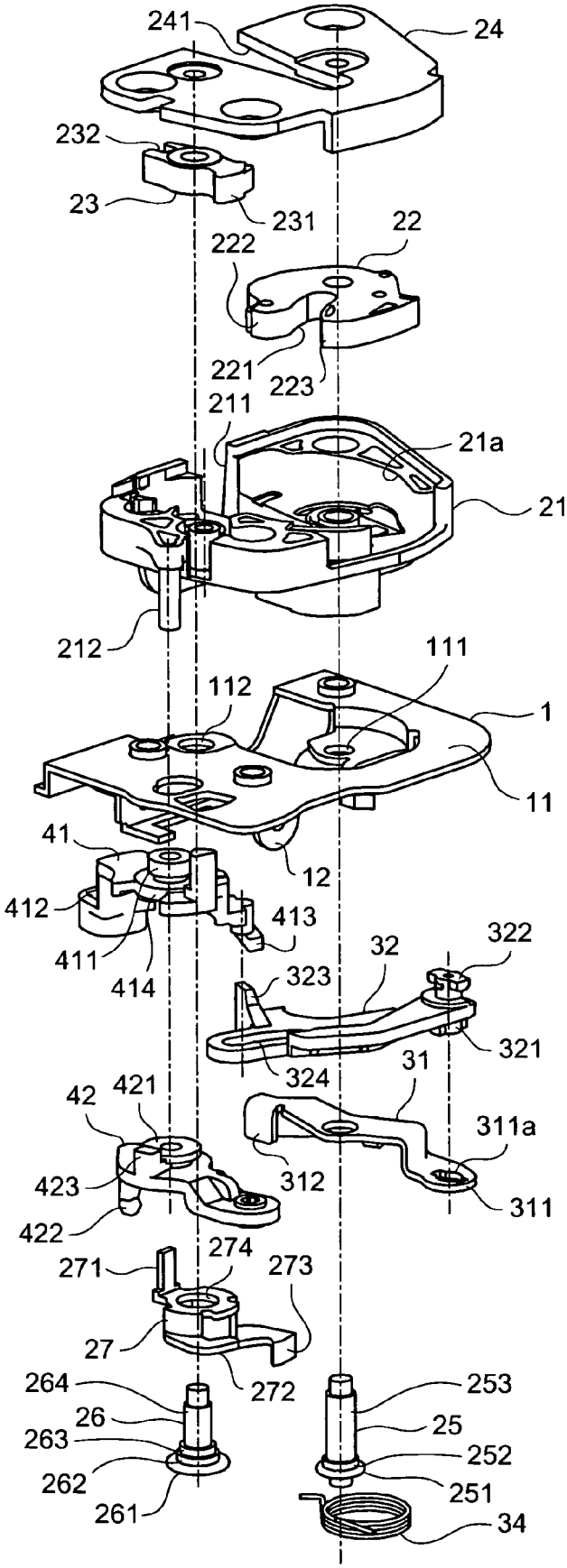
FIG. 11 is an exploded perspective view of the door lock device.
Figure 12:
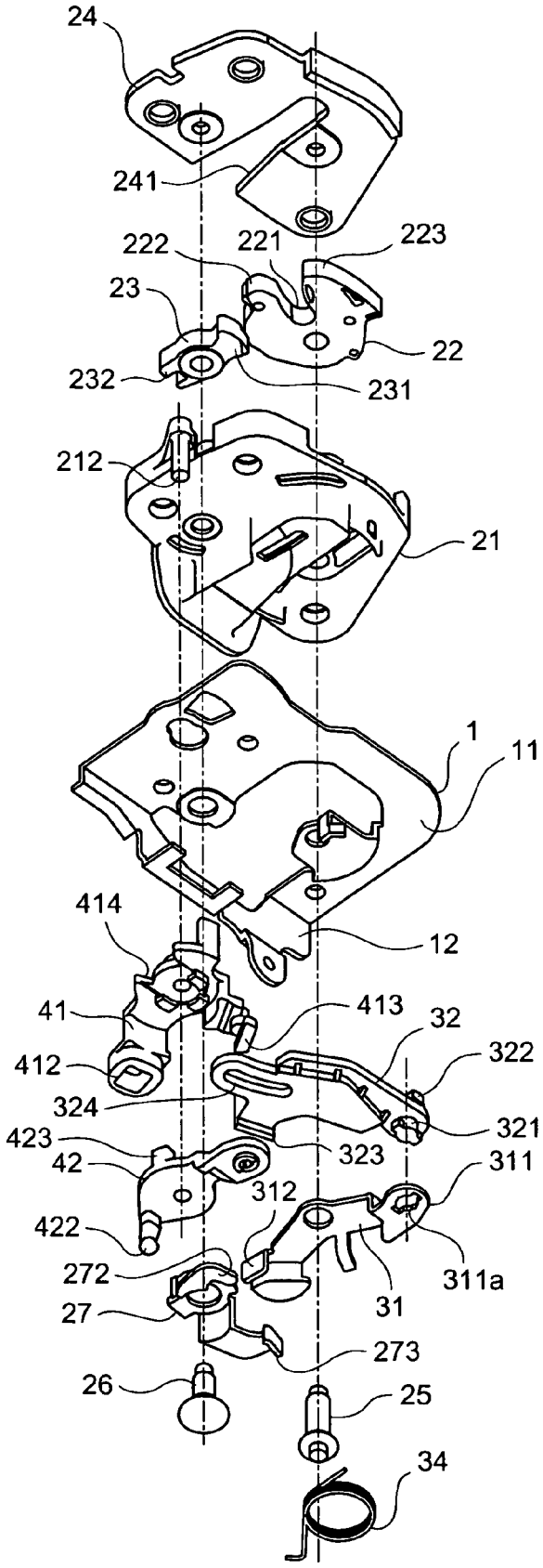
FIG. 12 is another exploded perspective view of the door lock device.
Figure 13:
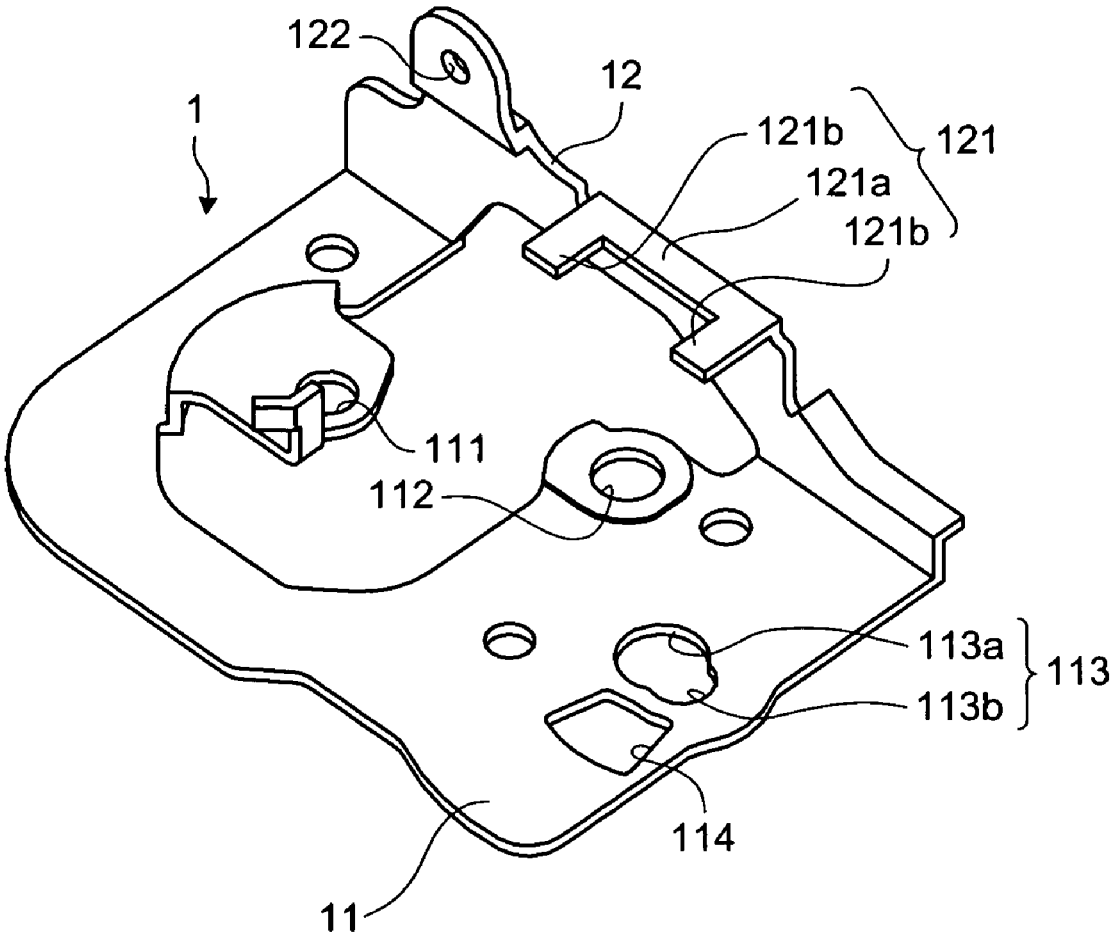
FIG. 13 is a perspective view of a base plate shown in FIG. 1.
Figure 14:
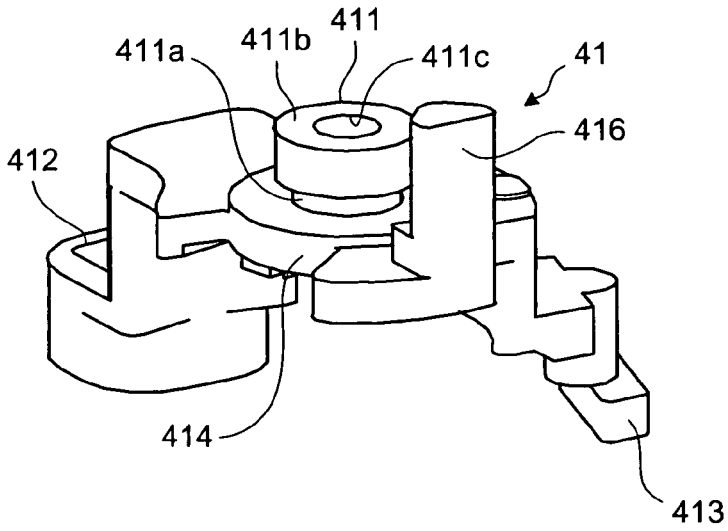
FIG. 14 is a perspective view of a lock lever shown in FIG. 1.
Figure 15:
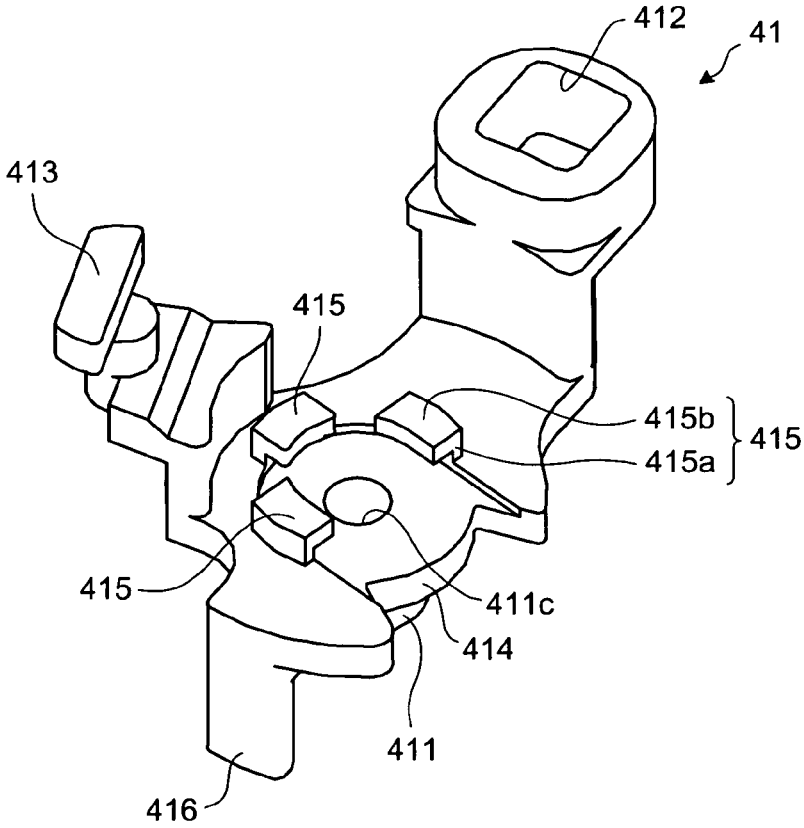
FIG. 15 is another perspective view of the lock lever.
Figure 16:
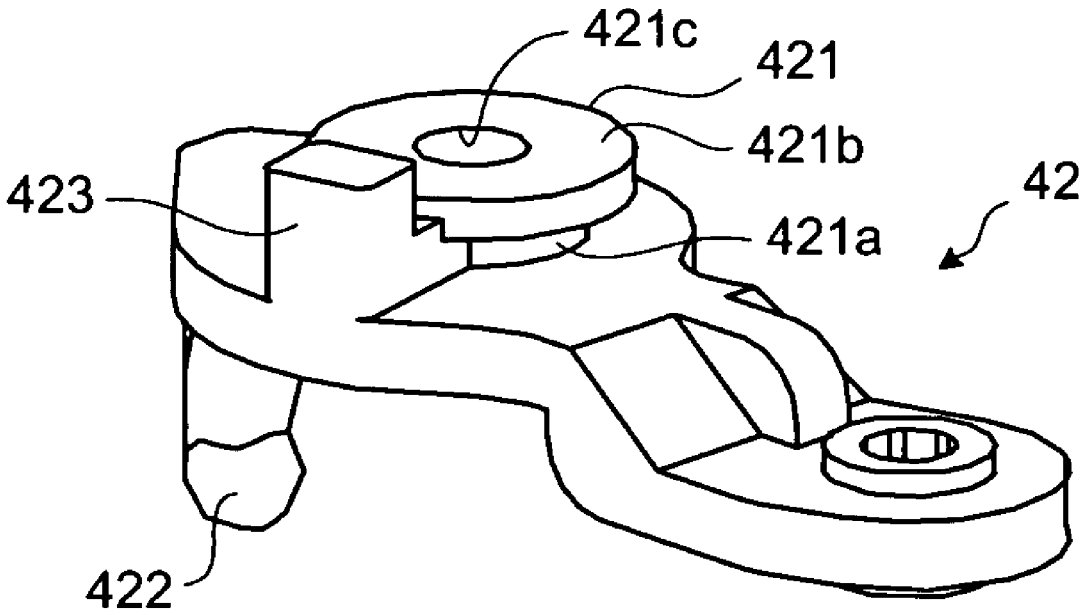
FIG. 16 is a perspective view of a key lever.
Figure 17:
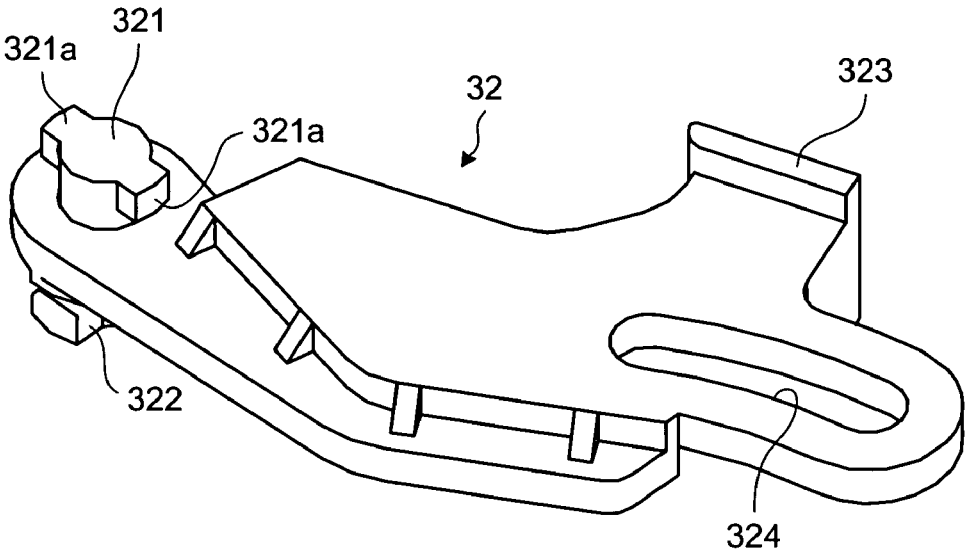
FIG. 17 is a perspective view of a link lever shown in FIG. 1.
Figure 18:
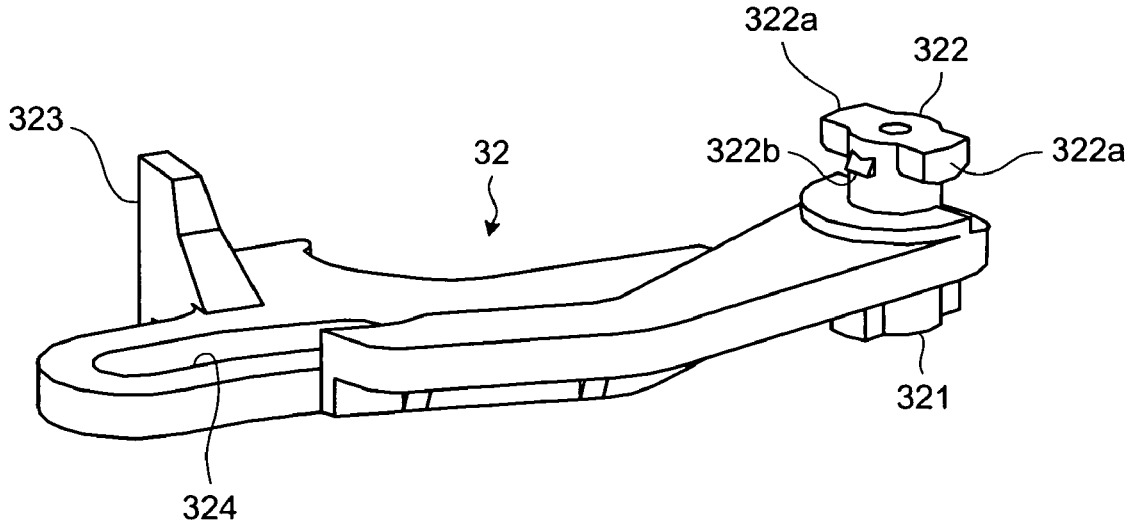
FIG. 18 is another perspective view of the link lever.
Figure 19A:
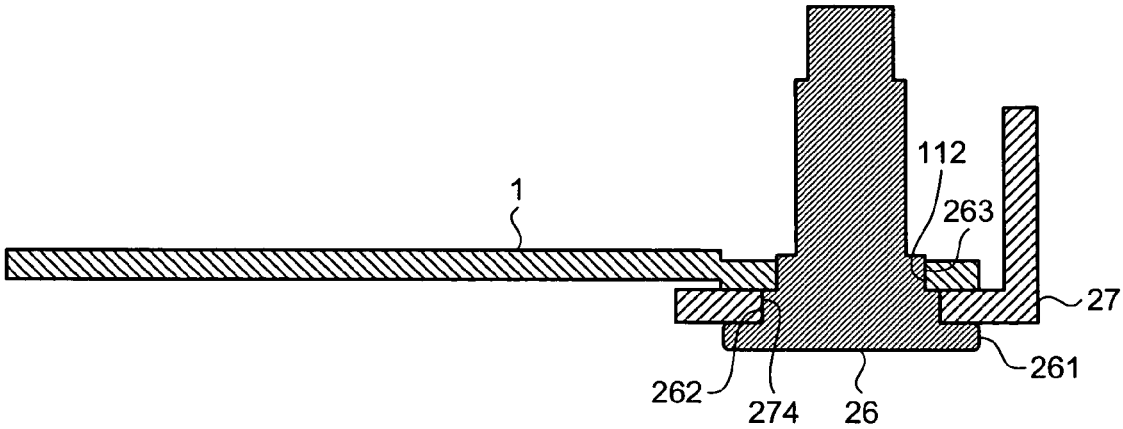
FIGS. 19A and 19B are schematics for explaining an assembly of a ratchet shaft shown in FIG. 1.
Figure 19B:
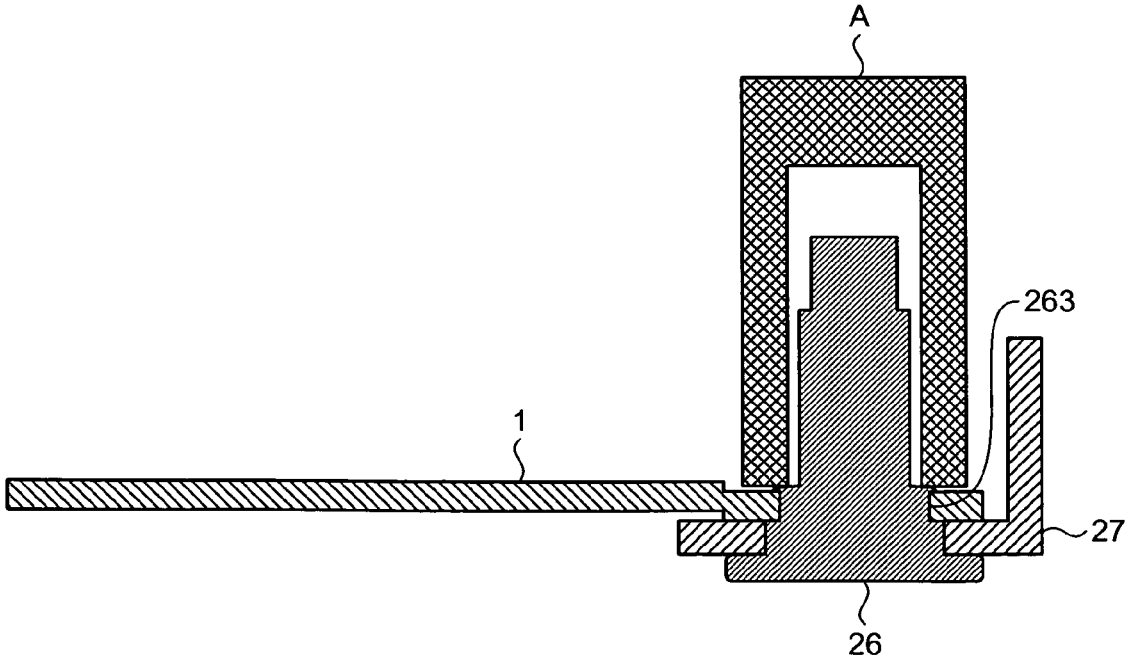
Figure 20A:
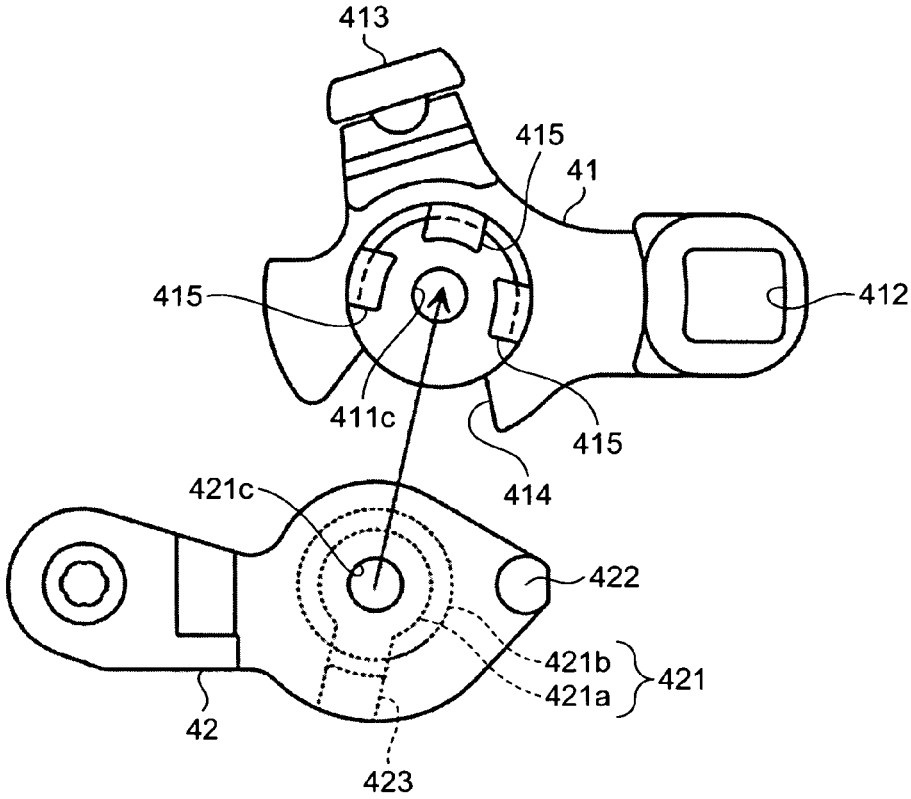
FIGS. 20A and 20B are schematics for explaining an assembly of the lock lever and the key lever.
Figure 20B:
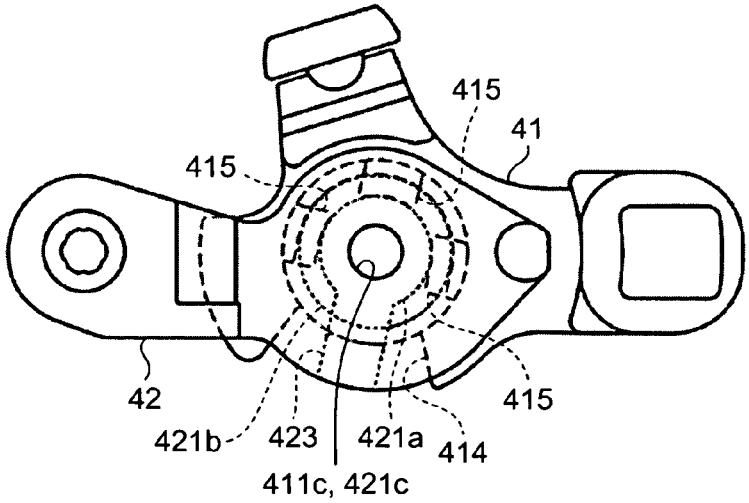
Figure 21A:
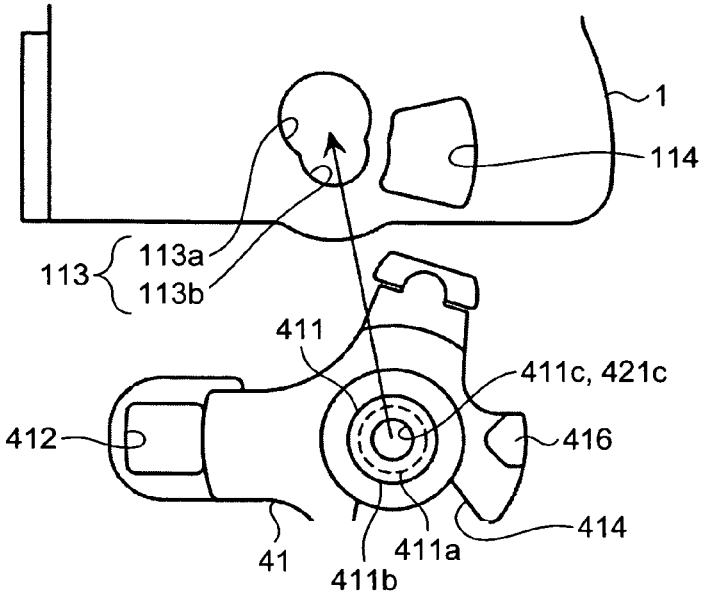
FIGS. 21A, 21B and 21C are schematics for explaining an assembly of the lock lever and the base plate.
Figure 21B:
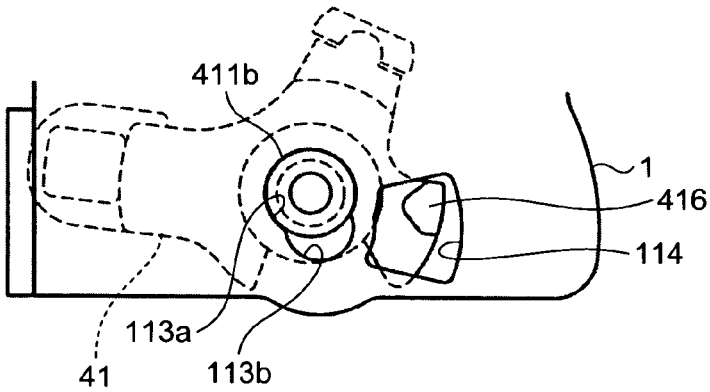
Figure 21C:
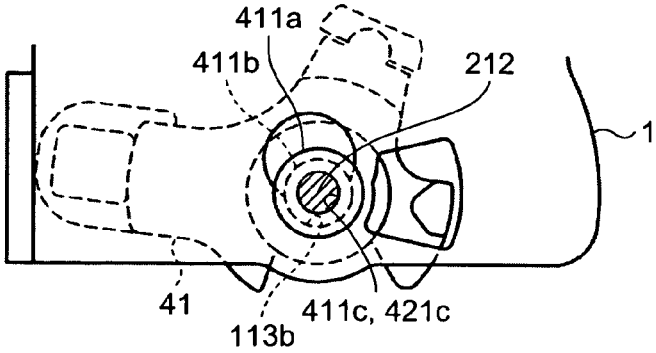
Figure 22:
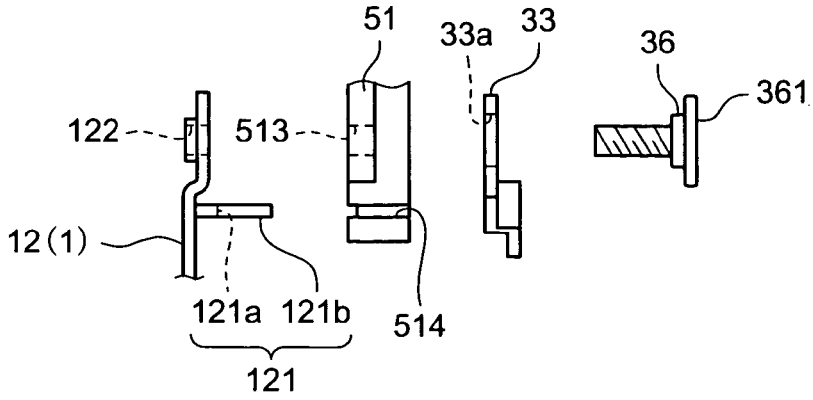
FIG. 22 is a schematic for explaining an assembly of the base plate and an actuator shown in FIG. 1.
Figure 23:
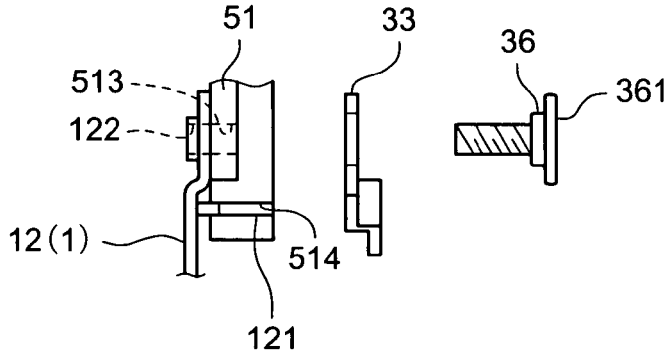
FIG. 23 is another schematic for explaining the assembly of the base plate and the actuator.
Figure 24:
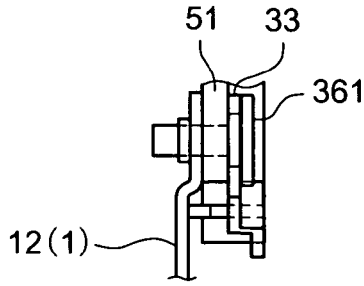
FIG. 24 is yet another schematic for explaining the assembly of the base plate and the actuator.

An assembly of the door lock device is described below. FIG. 11 is an exploded perspective view of the door lock device shown. FIG. 12 is another exploded perspective view of the door lock device. FIG. 13 is a perspective view of the base plate 1. FIGS. 14 and 15 are perspective views of the lock lever 41. FIG. 16 is a perspective view of the key lever 42. FIGS. 17 and 18 are perspective views of the link lever 32. FIGS. 19A and 19B are schematics for explaining an assembly of the ratchet shaft 26. FIGS. 20A and 20B are schematics for explaining an assembly of the lock lever 41 and the key lever 42. FIGS. 21A to 21C are schematics for explaining an assembly of the lock lever 41 and the base plate 1. FIGS. 22 to 24 are schematics for explaining an assembly of the base plate 1 and the actuator 51.

The structures of the principal parts in the assembly of the door lock device are described below. The latch shaft 25 has at its base end a flange collar 251 and a first stepped portion 252 that receives the thickness of the open lever 31 and supports the open lever 31 to be rotatable. At the front end of the first stepped portion 252, the latch shaft 25 has a second stepped portion 253 that receives the thickness of a stacked assembly of the base plate 1, the latch body 21, and the cover plate 24, and supports the latch 22 to be rotatable between the latch body 21 and the cover plate 24.

The ratchet shaft 26 has at its base end a flange collar 261 and a first stepped portion 262 that receives the thickness of the ratchet lever 27 and supports the ratchet lever 27 to be rotatable. At the front end of the first stepped portion 262, the ratchet shaft 26 has a second stepped portion 263 that receives the thickness of the base plate 1. At the front end of the second stepped portion 263, the ratchet shaft 26 has a third stepped portion 264 that receives the thickness of a stacked assembly of the latch body 21 and the cover plate 24, and supports the ratchet 23 to be rotatable between the latch body 21 and the cover plate 24.

As shown in FIG. 13, the base 11 has a latch shaft hole 111 into which the latch shaft 25 is inserted, a ratchet shaft hole 112 into which the ratchet shaft 26 is inserted, and a lock lever shaft hole 113 that supports the lock lever shaft 411 of the lock lever 41 to be rotatable on the base 11. The lock lever shaft hole 113 includes an insertion hole 113*a* into which the lock lever shaft 411 is inserted and an axle bearing hole 113*b* of a smaller inner diameter than and contiguous with the insertion hole 113*a*and that supports the lock lever shaft 411 to be rotatable. The base 11 has a rotation regulating hole 114 near the lock lever shaft hole 113 that relates to the lock lever 41.

As shown in FIG. 13, the side plate 12 has an insertion piece 121 for mounting the actuator 51. The insertion piece 121 includes a first insertion piece 121*a*and a pair of second insertion pieces 121*b*. The first insertion piece 121*a* is formed by clinching the edge of the side plate 12 in a direction substantially parallel to the base 11. The second insertion pieces 121*b* also extend substantially parallel to the base 11 from either end of the first insertion piece 121*a*. The side plate 12 has a screw hole 122 for mounting the actuator 51 and the inside handle lever 33. The screw hole 122 is formed to receive a fixing screw 361 that forms a fastening member described later in the same direction as the extension direction of the insertion piece 121.

As shown in FIG. 14, the lock lever 41 has the lock lever shaft 411 on its rear surface that faces the base plate 1. The lock lever shaft 411 includes a bar member 411*a* and a flange member 411*b*. The bar member 411*a* is a cylindrical extension formed integrally with the lock lever 41, and the flange member 411*b* projects in the outer radial direction at the end of the bar member 411*a*. The lock lever shaft 411 has a shaft hole 411*c* at the center (axial center) of the bar member 411*a*. The flange member 411*b* of the lock lever shaft 411 has an outer radius that allows the flange member 411*b* to be inserted into the insertion hole 113*a* of the lock lever shaft hole 113. Similarly, the bar member 411*a* of the lock lever shaft 411 has an outer radius that allows the bar member 411*a* to be rotatably engaged with the axle bearing hole 113*b* of the lock lever shaft hole 113.

As shown in FIG. 15, the lock lever 41 has shaft bushes 415 on its front side that faces the key lever 42. The shaft bushes 415 support the key lever shaft 421 of the key lever 42 to be rotatable concentrically with the lock lever shaft 411. The shaft bushes 415 have a hook-like shape formed integrally with the lock lever 41 and are arranged around the axis of the lock lever shaft 411. Each shaft bush 415 has a supporting piece 415*a* extending along the axis of the lock lever shaft 411 and a locking piece 415*b* extending from the upper end of the supporting piece 415*a* towards the axial center. The plurality of shaft bushes 415 (three in this embodiment) is arranged around the axis of the lock lever shaft 411, being open only in a direction orthogonal to the axial center of the lock lever shaft 411. The shaft bushes 415 can be continuous as long as the shaft bushes 415 are arranged open in a direction orthogonal to the axial center of the lock lever shaft 411.

As shown in FIGS. 14 and 15, the lock lever 41 has a regulating protrusion 416 extending from the rear surface.

As shown in FIG. 16, the key lever 42 has the key lever shaft 421 on its rear surface that faces the lock lever 41. The key lever shaft 421 includes a bar member 421*a* and a flange member 421*b*. The bar member 421*a* is a cylindrical extension formed integrally with the key lever 42, and the flange member 421*b* projects in the outer radial direction at the end of the bar member 421*a*. The key lever shaft 421 has a shaft hole 421*c* at the center (axial center) of the bar member 421*a*. The shaft hole 421*c* has the same inner diameter as that of the shaft hole 411*c* of the lock lever 41. The flange member 421*b* of the key lever shaft 421 has an outer radius that allows the flange member 421*b* to be rotatably engaged with the supporting pieces 415*a* of the shaft bushes 415 of the lock lever 41. Similarly, the bar member 421*a* of the key lever shaft 421 has an outer radius that allows the bar member 421*a* to be rotatably engaged with the locking pieces 415*b* of the shaft bushes 415 of the lock lever 41.

As shown in FIG. 17, the link lever 32 has the first link shaft 321 on the front surface (the first surface) of the upper end. The link lever 32 is coupled with and axially supported against the first opening operation end 311 by the first link shaft 321. The first link shaft 321 has at its end a pair of locking protrusions 321*a*orthogonal to the axle of the first link shaft 321 and extending in an outer radial direction. The first opening operation end 311 has a shaft hole 311*a* (see FIGS. 11 and 12) of a shape that allows insertion of the first link shaft 321 including its locking protrusions 321*a*. In other words, when the open lever 31 and the link lever 32 are coupled with each other, the locking protrusions 321*a*engage to the rim of the shaft hole 311*a* by mutual rotation of the locking protrusions 321*a* and the first link shaft 321 passing therethrough.

As shown in FIG. 18, the link lever 32 has on the rear surface (the second surface) of the upper end the second link shaft 322 coaxial with the first link shaft 321. The link lever 32 is slidably engaged with the oblong slot 351 of the open rod 35 that links to the outside handle (not shown) through the second link shaft 322. The second link shaft 322 has at its end a pair of locking protrusions 322*a*orthogonal to the axle of the second link shaft 322 and extending in an outer radial direction. The second link shaft 322 has on its side a locking pawl 322*b*. In other words, when the open rod 35 and the link lever 32 are coupled with each other, the locking protrusions 322*a*engage to the rim of the oblong slot 351 by mutual rotation of the oblong slot 351 and the second link shaft 322 passing therethrough. The locking pawl 322*b* provisionally retains the second link shaft 322 in the oblong slot 351.

The assembling of the door lock device is described below. The assembling of the door lock device is carried out by sliding in each of the parts from the end sides of the upward-facing latch shaft 25 and the ratchet shaft 26, as shown in FIGS. 11 and 12, and caulking the ends. Specifically, the base ends of the latch shaft 25 and the ratchet shaft 26 are appropriately secured and the parts are then slid one by one over the latch shaft 25 and the ratchet shaft 26.

As shown in FIG. 19A, first, an axle bearing hole 274 of the ratchet lever 27 is engaged with the ratchet shaft 26 so that the ratchet lever 27 rests against the first stepped portion 262 of the ratchet shaft 26. Then the ratchet shaft hole 112 of the base plate 1 is engaged with the second stepped portion 263 of the ratchet shaft 26. Next, as shown in FIG. 19B, the second stepped portion 263 of the ratchet shaft 26 is caulked to the base plate 1 by a caulking sleeve A that covers the end of the ratchet shaft 26. The open lever 31 is engaged with the first stepped portion 252 of the latch shaft 25, and then the latch shaft hole 111 of the base plate 1 is engaged with the latch shaft 25.

Next the latch body 21 with its opening 21*a* facing upward is engaged with the latch shaft 25 and the ratchet shaft 26 so that the latch body 21 rests against the second stepped portion 253 and the third stepped portion 264. The latch 22 is then engaged with the second stepped portion 253 of the latch shaft 25, and similarly, the ratchet 23 is engaged with the third stepped portion 264 of the ratchet shaft 26. Thus, both the latch 22 and the ratchet 23 are accommodated in the latch body 21. The acting member 232 and the linking end 271 are then coupled with each other. The latch 22 and the ratchet 23 are accommodated in the latch body 21 with the latch spring and ratchet spring being respectively engaged with the latch 22 and the ratchet 23.

The opening 21*a* of the latch body 21 is covered with the cover plate 24. The ends of the latch shaft 25 and the ratchet shaft 26 extending from the cover plate 24 are caulked to the cover plate 24.

The lock lever 41 and the key lever 42 are mounted on the base plate 1 stacked one upon the other prior to sliding the latch body 21 over the latch shaft 25 and the ratchet shaft 26. Specifically, as shown in FIGS. 20A and 20B, the flange member 421*b* of the key lever shaft 421 is engaged with the shaft bushes 415 of the lock lever 41. Thus, the key lever 42 is arranged to be rotatable about the key lever shaft 421 against the lock lever 41 with the shaft hole 411*c* and the shaft hole 421*c* stacked one upon the other.

To mount the stacked-together lock lever 41 and the key lever 42 on the base plate 1, as shown in FIGS. 21A to 21C (the key lever 42 is not shown in FIGS. 21A to 21C), the flange member 411*b* is inserted into the insertion hole 113*a* in the base plate 1. In the inserted state, the lock lever 41 is moved to the axle bearing hole 113*b* side to engage the bar member 411*a* of the lock lever shaft 411 with the axle bearing hole 113*b*. The latch body 21 is then slid into the latch shaft 25 and the ratchet shaft 26 and secured to the base plate 1. Upon mounting the latch body 21, a supporting shaft 212 (shown in FIGS. 11 and 12) formed integrally with the latch body 21 is inserted into the shaft hole 411*c* and the shaft hole 421*c*. Thus, the lock lever 41 is supported to be rotatable with respect to the base plate 1, and the key lever 42 is supported to be rotatable with respect to the lock lever 41.

With the open rod 35 mounted on the second link shaft 322, the first link shaft 321 of the link lever 32 is inserted into the shaft hole 311*a* of the first opening operation end 311. The oblong curved slot 324 of the link lever 32 engages with the engagement piece 413.

Finally, the actuator 51 is mounted on the base plate 1. The actuator 51 is fixed to the side plate 12 through the insertion piece 121 and the screw hole 122. As shown in FIG. 22, the actuator 51 has an insertion hole 513 for the fixing screw 361 and a groove 514 into which the first insertion piece 121*a* and the second insertion pieces 121*b* of the insertion piece 121 are inserted and engaged and which allows the first insertion piece 121*a* and the second insertion pieces 121*b* to move only along the direction of tightening the fixing screw 361. The fixing screw 361 is a stepped screw. The stepped portion of the fixing screw 361 is inserted into an axle bearing hole 33*a* of the inside handle lever 33 and serves as the lever shaft 36 of the inside handle lever 33. As shown in FIG. 23, to mount the actuator 51 onto the base plate 1, the groove 514 of the actuator 51 is fitted with the insertion piece 121 of the base plate 1. Then, as shown in FIG. 24, the fixing screw 361 with the inside handle lever 33 is tightened into the screw hole 122 of the base plate 1. The direction of engaging the actuator 51 with the insertion piece 121 and the direction of tightening the fixing screw 361 are the same.

In the door lock device described above, the lock lever 41 is mounted on the base plate (predetermined base member) 1 to be rotatable with respect to the base plate 1 by a lever mounting mechanism that includes the lock lever shaft 411, the shaft hole (axle bearing) 113, and the supporting shaft (regulating member) 212. The lock lever shaft 411 has the bar member 411*a* formed integrally with the lock lever 41 and the flange member 411*b* projecting in the outer radial direction from the end of the bar member 411*a*. The shaft hole 113 is formed on the base plate 1 and guides the lock lever shaft 411 in a predetermined direction orthogonal to the axle of the lock lever shaft 411, engages with the flange member 411*b*, regulating the movement of the lock lever shaft 411 along the direction of the axis of the lock lever shaft 411 as well as supporting the lock lever shaft 411 to be rotatable. The supporting shaft 212 secures the lock lever shaft 411 to the base plate 1 and regulates the movement of the lock lever shaft 411 in the direction orthogonal to the axle of the lock lever shaft 411. As a result, the lock lever 41 can be mounted easily without bolts, etc. for the rotation axis, and the fitting strength is sufficient against external force.

The supporting shaft 212 passes through the shaft hole 411*c* formed along the axis of the lock lever shaft 411 and supports the lock lever shaft 411 to be rotatable in cooperation with the lock lever shaft hole 113. As a result, the lock lever 41 can be mounted to rotate smoothly.

The lock lever (first lever) 41 and the key lever (second lever) 42 are mounted, one upon the other, to be independently rotatable with respect to the base plate 1 by a lever mounting mechanism that includes the lock lever shaft (first shaft) 411, the lock lever shaft hole (first axle bearing) 113, the key lever shaft (second shaft) 421, the shaft bushes (second axle bearing) 415, and the supporting shaft (the regulating member) 212. The lock lever shaft 411 has the bar member 411*a* formed integrally with the lock lever 41 and the flange member 411*b* projecting in the outer radial direction from the end of the bar member 411*a*. The lock lever shaft hole 113 is formed on the base plate 1 and guides the lock lever shaft 411 to be movable in a predetermined direction orthogonal to the axle of the lock lever shaft 411, engages with the flange member 411*b*, regulating the movement of the lock lever shaft 411 along the direction of the axle of the lock lever shaft 411 as well as supporting the lock lever shaft 411 to be rotatable. The key lever shaft 421 has the bar member 421*a* formed integrally with the key lever 42 and the flange member 421*b* projecting in the outer radial direction from the end of the bar member 421*a*. The shaft bushes 415 are provided in the lock lever 41 and guide the key lever shaft 421 to be movable in a predetermined direction orthogonal to the axle of the key lever shaft 421, engages with the flange member 421*b*, regulating the movement of the key lever shaft 421 along the direction of the axle of the key lever shaft 421 as well as supporting the key lever shaft 421 to be rotatable about the same axis as the lock lever shaft 411. The supporting shaft 212 is fixed to the base plate 1 and regulates the movement of the lock lever shaft 411 in the direction orthogonal to the axle of the lock lever shaft 411. As a result, the lock lever 41 and the key lever 42 can be mounted easily without bolts, etc. for the rotation axis, and the fitting strength is sufficient against external force. In this case, the key lever shaft 421 can be provided on either one of the lock lever 41 or the key lever 42, and the shaft bushes 415 can be provided on the other lever.

The supporting shaft (the regulating member) 212 passes through the shaft hole 411*c* formed along the axis of the lock lever shaft 411 and the shaft hole 421*c* formed along the axis of the key lever shaft 421, and supports the lock lever shaft 411 and the key lever shaft 421 to be rotatable in cooperation with the lock lever shaft hole 113 and the shaft bushes 415. As a result, the lock lever 41 and the key lever 42 can be mounted to rotate smoothly.

The door lock device is configured to release the latch mechanism by coupling the link lever 32 with the open lever 31 and coupling the open rod 35, which is coupled with the outside handle, with the open lever 31, and releasing the latch mechanism by conveying the operation of the outside handle to the link lever 32 from the open lever 31. For this purpose, the first link shaft 321 and the second link shaft 322 are integrally provided on the link lever 32. The first link shaft 321 slidably engages the link lever 32 with the open lever 31. The second link shaft 322 slidably engages the open rod 35 to the link lever 32. As a result, the number of parts required for coupling the open lever 31, the link lever 32, and the open rod 35 can be reduced, resulting in a compact door lock device.

Further, the first link shaft 321 is provided on the first surface and the second link shaft 322 is provided on the second surface of the link lever 32. As a result, the linking regions for the open lever 31, the link lever 32 and the open rod 35 are aggregated on the surfaces of the link lever 32, and a compact door lock device can be realized.

The first link shaft 321 and the second link shaft 322 are arranged coaxially. As a result, with less operative force of the outside handle, the operation can be conveyed to the link lever 32 from the open lever 31.

The link lever 32 along with the first link shaft 321 and the second link shaft 322 is formed of synthetic resin. As result, the resistance during the sliding movement of the open lever 31 and the open rod 35 can be reduced and the door lock device can be made lighter.

The door lock device is configured to accommodate the latch 22 and the ratchet 23 in the latch body (the housing) 21, which is sandwiched between the cover plate 24 covering the opening 21*a* of the latch body 21 and the base plate 1, and to include the ratchet lever 27 supported by the ratchet shaft 26 outside the base plate 1 and that passes through the latch shaft 25 supporting the latch 22 and the ratchet shaft 26 supporting the ratchet 23 and moves integrally with the ratchet 23. The ratchet shaft 26 has at its base end the flange collar 261 and the first stepped portion 262 that supports the ratchet lever 27 to be rotatable, and towards the front end of the first stepped portion 262, the second stepped portion 263 that receives the thickness of the base plate 1. The second stepped portion 263 is caulked to the base plate 1 with the ratchet lever 27 resting against the first stepped portion 262 and the base plate 1 resting against the second stepped portion 263. As a result, by securing the ratchet shaft 26 to the base plate 1 beforehand, the play of the ratchet lever 27 in the direction of the shaft axis can be suppressed and the assembling operation can be improved.

The assembling method of the door lock device configured to accommodate the latch 22 and the ratchet 23 in the latch body 21, which is sandwiched between the cover plate 24 covering the opening 21*a* of the latch body 21 and the base plate 1, and includes the ratchet lever 27 supported by the ratchet shaft 26 outside the base plate 1 and that passes through the latch shaft 25 supporting the latch 22 and the ratchet shaft 26 supporting the ratchet 23 and moves integrally with the ratchet 23 includes passing the base plate 1 through the ratchet shaft 26 that supports the ratchet lever 27 to be rotatable and caulking the ratchet shaft 26 to the base plate 1 as well as passing the base plate 1 through the latch shaft 25 facing the same direction as the ratchet shaft 26, and passing the latch body 21 through both the ratchet shaft 26 and the latch shaft 25, passing the latch 22 through the latch shaft 25 and the ratchet 23 through the ratchet shaft 26 into the latch body 21, covering the opening 21*a* of the latch body 21 and caulking the ends of the latch shaft 25 and the ratchet shaft 26 to the cover plate 24 from the outside. As a result, by caulking the ratchet shaft 26 and the latch shaft 25 from the same direction, the play of the ratchet lever 27 in the direction of the shaft axis can be suppressed and the assembling operation can be improved.

In the embodiment described above, only the ratchet shaft 26 is secured beforehand to the base plate 1. However, in addition to the ratchet shaft 26, the latch shaft 25 can also be secured beforehand to the base plate 1.

The door lock device is configured to allow activation of the latch mechanism and the lock mechanism by operating the actuator 51. To mount the actuator 51 based on the base plate 1 on which the latch mechanism is mounted has the insertion piece 121 which fits with the groove 514 of the actuator 51. The fixing screw 361 (the fastening member) that serves as a supporting shaft for the inside handle lever 33 that operates the latch mechanism fastens the actuator 51 to the base plate 1 and keeps the groove 514 remain fitted with the insertion piece 121. As a result, by mounting the actuator 51 on the base plate 1 by the insertion piece 121, the groove 514, and the fixing screw 361, the mounting operation can be improved. Further, according to the activation of the actuator 51, the meshing engagement between the latch 22 and the ratchet 23 is released in the latch mechanism, and the locked state and the unlocked state can be switched in the lock mechanism.

The actuator 51 is inserted into the base plate 1 allowing the movement of the groove 514 and the insertion piece 121 only in the direction of tightening the fixing screw 361. As a result, the insertion direction of the actuator 51 into the base plate 1 is the same as the direction of tightening the fixing screw 361, and the mounting operation of the actuator 51 can be improved.

The fixing screw 361 has a stepped portion that supports the inside handle lever 33 to be rotatable. As a result, while mounting of the base plate 1, the actuator 51, and the inside handle lever 33, looseness or over-tightening can be prevented in the rotation of the inside handle lever 33.

The fixing screw 361 is used as the fastening member in the embodiment. Any appropriate substitute can be used.

As described above, according to an embodiment of the present invention, a ratchet shaft is secured to a base plate beforehand. Besides, both the ratchet shaft and a latch shaft are caulked from the same direction. Thus, while the looseness of a ratchet lever is suppressed in the direction of the shaft axis, the assembling operation can be improved.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door lock device, comprising:

a structure including:

a housing having an opening on one side of the housing configured to accommodate a latch supported by a latch shaft penetrating through the structure;

a ratchet supported by a ratchet shaft penetrating through the structure, the ratchet shaft having a flange collar at a base end of the ratchet shaft;

a cover plate configured to cover the opening;

a base plate on another side of the housing such that the housing is sandwiched between the base plate and the cover plate; and a ratchet lever supported by the ratchet shaft and configured to rotate integrally with the ratchet, wherein the ratchet shaft includes a first stepped portion having a first end next to the base end, and a second end, the first stepped portion rotatably supporting the ratchet lever; and a second stepped portion receiving a thickness of the base plate, with the base plate contacting the second end of the first stepped portion, the second stepped portion having a diameter different than the first stepped portion, and the second stepped portion is configured to be caulked to the base plate with the first stepped portion through the ratchet lever and the second stepped portion through the base plate.

2. A method of assembling a door lock device according to claim 1, the method comprising:

engaging the ratchet shaft with the ratchet lever so that the ratchet lever is rotatable;

engaging the ratchet shaft engaged with the ratchet lever with the base plate and caulking the ratchet shaft to the base plate;

engaging the latch shaft facing the same direction as the ratchet shaft with the base plate;

engaging the ratchet shaft and the latch shaft with the housing;

engaging the latch shaft with the latch and engaging the ratchet shaft with the ratchet and then covering the opening with the cover plate; and caulking an end of the latch shaft and an end of the ratchet shaft to the cover plate.

* * * * *